US008550590B2

(12) United States Patent
Ito

(10) Patent No.: US 8,550,590 B2
(45) Date of Patent: Oct. 8, 2013

(54) IMAGE RECORDING APPARATUS

(75) Inventor: Koji Ito, Gifu (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 913 days.

(21) Appl. No.: 12/254,495

(22) Filed: Oct. 20, 2008

(65) Prior Publication Data

US 2009/0102874 A1 Apr. 23, 2009

(30) Foreign Application Priority Data

Oct. 18, 2007 (JP) ..... 2007-270968

(51) Int. Cl.
*B41J 29/393* (2006.01)

(52) U.S. Cl.
USPC ..... 347/19; 347/23

(58) Field of Classification Search
USPC ..... 347/14, 19, 23
See application file for complete search history.

(56) References Cited

U.S. PATENT DOCUMENTS

| | | | | |
|---|---|---|---|---|
| 6,109,745 | A * | 8/2000 | Wen | 347/16 |
| 7,334,859 | B2 | 2/2008 | Kojima | |
| 2004/0022570 | A1 | 2/2004 | Ioka et al. | |
| 2004/0109718 | A1 * | 6/2004 | Ikeno et al. | 400/708 |
| 2004/0257394 | A1 * | 12/2004 | Hoshiyama et al. | 347/19 |
| 2005/0024410 | A1 * | 2/2005 | Subirada et al. | 347/16 |
| 2005/0078145 | A1 * | 4/2005 | Inoue | 347/31 |
| 2005/0128276 | A1 | 6/2005 | Yamada | |
| 2006/0114281 | A1 * | 6/2006 | Otsuki | 347/19 |
| 2006/0216047 | A1 | 9/2006 | Yamamoto et al. | |
| 2008/0050140 | A1 * | 2/2008 | Oku | 399/71 |

FOREIGN PATENT DOCUMENTS

| | | | |
|---|---|---|---|
| JP | H06-340141 | A | 12/1994 |
| JP | H10-95150 | A | 4/1998 |
| JP | H11-188863 | A | 7/1999 |
| JP | 2002-283667 | A | 10/2002 |
| JP | 2003-072079 | A | 3/2003 |
| JP | 2003-291325 | A | 10/2003 |
| JP | 2004-341051 | A | 12/2004 |
| JP | 2005-169990 | A | 6/2005 |
| JP | 2006-205742 | A | 8/2006 |
| JP | 2006-289810 | A | 10/2006 |

OTHER PUBLICATIONS

Japan Patent Office, Notification of Reason for Refusal for Japanese Patent Application No. 2007-270968, dispatched Nov. 8, 2011.

* cited by examiner

*Primary Examiner* — Julian Huffman
(74) *Attorney, Agent, or Firm* — Baker Botts L.L.P.

(57) ABSTRACT

An image recording apparatus including: a medium-convey mechanism; a recording head; an image sensor configured to perform an image-pickup operation for a recording medium; an image-pickup controlling section which controls the image sensor to perform the image-pickup operation; a liquid-ejection-failure recognizing section which recognizes presence and absence of a liquid ejection failure on the basis of a portion of image data obtained by the image-pickup operation, which portion corresponds to the image; a medium-position recognizing section which recognizes a position of the recording medium relative to the recording head, on the basis of a portion of the image data which includes data corresponding to an outline of the recording medium; a medium-position judging section which judges whether the position is normal or not; and a recording data correcting section which corrects, where the position is not normal, recording data such that an image to be recorded becomes proper.

16 Claims, 12 Drawing Sheets

IMAGE RECORDING APPARATUS

CROSS REFERENCE TO RELATED APPLICATION

The present application claims priority from Japanese Patent Application No. 2007-270968, which was filed on Oct. 18, 2007, the disclosure of which is herein incorporated by reference in its entirety.

BACKGROUND OF THE INVENTION

1. Field of the Invention

The present invention relates to an image recording apparatus configured to eject liquid to record an image on a recording medium, and more particularly to an image recording apparatus equipped with an image sensor which picks up a recorded image.

2. Description of the Related Art

Recently, there has been developed an ink-jet printer using a line head having a recording range larger than a width of a recording sheet as a recording medium. In such a line printer, recording for each extremely narrow portion of the recording sheet extending in a direction in which the recording sheet is conveyed is carried out only by a corresponding one of nozzles. Thus, even where there are only a small number of nozzles in which an ink ejection failure occurs such as non-ejection of inks (liquids), variation of an ejected ink amount, and a deviation of a direction in which the inks are ejected, a white patch or line, or unevenness is formed or developed on the recording sheet, thereby deteriorating an image quality by a relatively large degree.

To solve this problem, in an ink-jet recording apparatus disclosed in Patent Document 1 (Japanese Patent Application Publication No. 2006-206742), image sensors of line type operable to read a test pattern recorded on a recording sheet are provided at respective positions each of which is adjacent to and located downstream of a corresponding one of recording heads in a direction in which the recording sheet is conveyed. Any nozzle in which an ink ejection failure occurs is detected on the basis of image data obtained by the image sensors of line type, and a prescribed recovering operation is performed for the nozzle. By a method like this, the nozzle in which the ink ejection failure occurs can be precisely detected to recover such nozzle.

Further, Patent Document 2 (Japanese Patent Application Publication No. 10-95160) discloses a printer in which a line sensor is disposed upstream of the ink-jet heads in a direction in which a recording sheet is conveyed. This printer is configured to detect, by the line sensor, an inclination of the recording sheet relative to the ink-jet heads, and configured to record an image on the recording sheet with no inclination by correcting recording data on the basis of a result of the detection. In accordance with an increase of a conveying speed of the recording sheet in order to meet a demand of high speed recording, there increases a possibility that the recording sheet is conveyed while being shifted and inclined.

SUMMARY OF THE INVENTION

To solve, in order to realize that an image to be recorded becomes a proper image, the above-described two problems of an image recording apparatus, i.e., both of the ink ejection failure and the inclination of the recording sheet, the image recording apparatus needs to be equipped with an image sensor for detecting the ink ejection failure and an image sensor for detecting the inclination of the recording sheet.

However, where the two image sensors are provided, a structure of the apparatus becomes complicated, and the apparatus cannot be manufactured with a relatively low cost.

This invention has been developed in view of the above-described situations, and it is an object of the present invention to provide an image recording apparatus configured to detect both of a liquid ejection failure and a sheet conveying failure, and having a relatively simple structure.

The object indicated above may be achieved according to the present invention which provides An image recording apparatus comprising: a medium-convey mechanism which conveys a recording medium; a recording head having an ejection surface from which liquid is ejected toward a surface of the recording medium being conveyed by the medium-convey mechanism and on which is provided a liquid ejection area extending in an ejection-area extending direction perpendicular to a medium-convey direction in which the recording medium is conveyed by the medium-convey mechanism; an image sensor having a pickup range extending in a direction that is the same as the ejection-area extending direction, and configured to perform an image-pickup operation for the surface of the recording medium being conveyed by the medium-convey mechanism; and a controller configured to execute controls for operations of the image recording apparatus, wherein the controller includes: an image-pickup controlling section configured to control the image sensor such that the image sensor performs the image-pickup operation for the recording medium on which an image is recorded by the recording head; a liquid-ejection-failure recognizing section configured to recognize presence and absence of a liquid ejection failure of the recording head on the basis of a portion of image data obtained by the image-pickup operation of the image sensor, which portion corresponds to the image; a medium-position recognizing section configured to recognize a position of the recording medium conveyed by the medium-convey mechanism, which position is relative to the recording head, on the basis of a portion of the image data obtained by the image-pickup operation of the image sensor, which portion includes data corresponding to an outline of the recording medium; a medium-position judging section configured to judge whether the position of the recording medium which has been recognized by the medium-position recognizing section is normal or not; and a recording data correcting section configured to correct, where the medium-position judging section has judged that the position of the recording medium is not normal, recording data transmitted to the recording head such that an image to be recorded on the recording medium on the basis of the recording data becomes proper.

The object indicated above may also be achieved according to the present invention which provides An image recording apparatus comprising: a medium-convey mechanism which conveys a recording medium; a recording head having an ejection surface from which liquid is ejected toward a surface of the recording medium being conveyed by the medium-convey mechanism and on which is provided a liquid ejection area extending in an ejection-area extending direction perpendicular to a medium-convey direction in which the recording medium is conveyed by the medium-convey mechanism; at least one image sensor each having a pickup range extending in a direction that is the same as the ejection-area extending direction, and each configured to perform an image-pickup operation for the surface of the recording medium being conveyed by the medium-convey mechanism; and a controller configured to execute controls for operations of the image recording apparatus, wherein the controller includes: an image-pickup controlling section configured to control at least one of the at least one image sensor such that the at least one of the at least one image sensor performs the image-pickup operation for the recording medium on which an image is recorded by the recording head; a liquid-ejection-failure recognizing section configured to recognize presence and absence of a liquid ejection failure of the recording head on the basis of a portion of image data obtained by the image-pickup operation of the at least one of the at least one image sensor, which portion corresponds to the image; a medium-position recognizing section configured to recognize a position of the recording medium conveyed by the medium-convey mechanism, which position is relative to the recording head, on the basis of a portion of the image data obtained by the image-pickup operation of the at least one of the at least one image sensor, which portion includes data corresponding to an outline of the recording medium; a medium-position judging section configured to judge whether the position of the recording medium which has been recognized by the medium-position recognizing section is normal or not; and a recording data correcting section configured to correct, where the medium-position judging section has judged that the position of the recording medium is not normal, recording data transmitted to the recording head such that an image to be recorded on the recording medium on the basis of the recording data becomes proper.

In the image recording apparatuses constructed as described above, the image to be recorded on the recording sheet can become proper, even though the image recording apparatus has a relatively simple structure, by using the image sensor both for detecting the presence and absence of an ink ejection failure and for detecting a sheet conveying failure caused by the sheet-convey mechanism.

BRIEF DESCRIPTION OF THE DRAWINGS

The objects, features, advantages, and technical and industrial significance of the present invention will be better understood by reading the following detailed description of a preferred embodiment of the invention, when considered in connection with the accompanying drawings, in which.

DESCRIPTION OF THE PREFERRED EMBODIMENT

Hereinafter, there will be described a preferred embodiment of the present invention by reference to the drawings. It is to be understood that the following embodiment is described only by way of example, and the invention may be otherwise embodied with various modifications without departing from the scope and spirit of the invention.

General Structure of Ink-jet Printer

Figure 1:
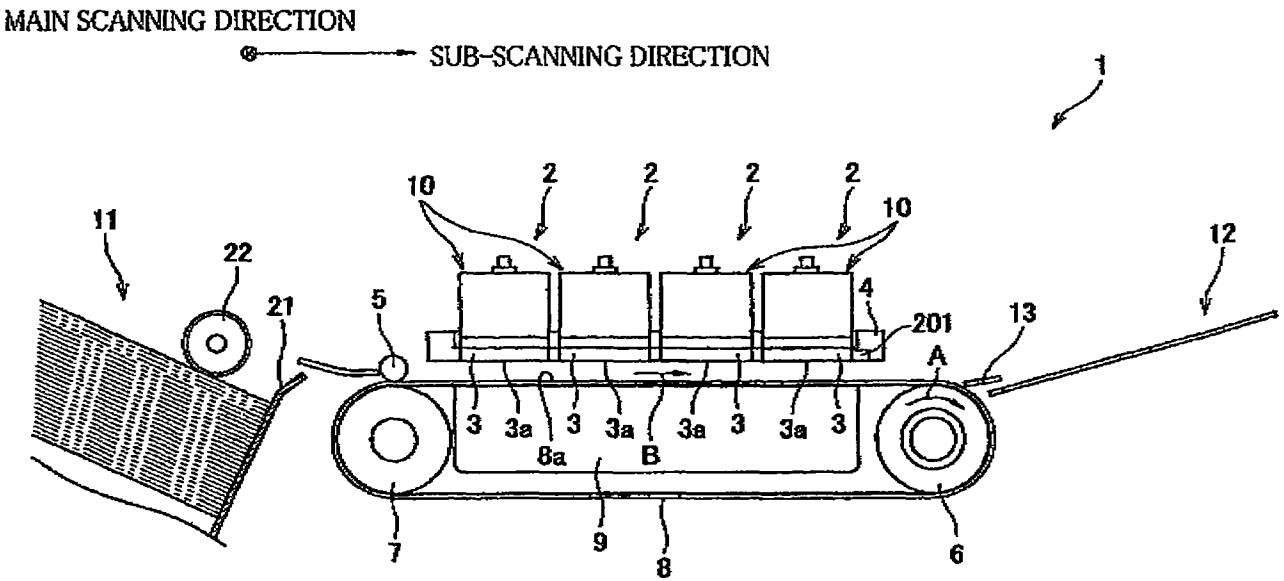
FIG. 1 is a side view of an ink-jet printer that is an image recording apparatus as an embodiment of the present invention.

FIG. 1 shows an ink-jet printer 1 that is an image recording apparatus as an embodiment of the present invention. The ink-jet printer 1 is a color ink-jet printer having ink-jet heads 2 respectively ejecting inks (liquids) of four colors, namely, magenta, cyan, yellow, and black. The ink-jet printer 1 is provided with a sheet-supply mechanism 11 located at a left portion of FIG. 1 and a sheet-discharge portion 12 located at a right portion of FIG. 1.

In the ink-jet printer 1, there is formed a sheet-convey path through which a recording sheet as a recording medium is conveyed from the sheet-supply mechanism 11 toward the sheet-discharge portion 12. The sheet-supply mechanism 11 is provided with a pickup roller 22. The pickup roller 22 is rotated by driving of a pickup motor 132 (shown in FIG. 6), whereby an uppermost one of the recording sheets in a sheet tray 21 is supplied and conveyed from the left side of FIG. 1 toward the right side of FIG. 1. At a middle portion of the sheet-convey path, a sheet-convey mechanism (a medium-convey mechanism) is disposed. The sheet-convey mechanism includes two belt rollers 6, 7 and an endless sheet-convey belt 8 wound around the belt rollers 6, 7 to bridge the belt rollers 6, 7. The endless sheet-convey belt 8 is for conveying the recording sheet.

An outer peripheral surface 8*a* of the sheet-convey belt 8 is subjected to a silicone processing to have a viscosity Just on a downstream side of the sheet-supply mechanism 11 in a sheet-convey direction B in which the recording sheet is conveyed, a sheet-press roller 5 is disposed at a position facing the sheet-convey belt 8. The sheet-press roller 5 presses, toward the outer peripheral surface 8*a* of the sheet-convey belt 8, the recording sheet supplied from the sheet-supply mechanism 11. Thus, the recording sheet pressed toward the outer peripheral surface 8*a* is conveyed in the sheet-convey direction B while being held by the outer peripheral surface 8*a* owing to the viscosity thereof. In this conveying of the recording sheet, a drive power of a sheet-convey motor 133 (shown in FIG. 6) is applied to the belt roller 6 located downstream of the belt roller 7 in the sheet-convey direction B, whereby the belt roller 6 is rotated in a clockwise direction in FIG. 1 (i.e., a direction indicated by arrow A).

A peeling plate 13 is provided just on a downstream side of the sheet-convey belt 8 in the sheet-convey direction B along the sheet-convey path. The peeling plate 13 peels, from the outer peripheral surface 8*a*, the recording sheet held by the outer peripheral surface 8*a*. Then, the recording sheet is conveyed on the peeling plate 13 toward the sheet-discharge portion 12 located on a right side of the peeling plate 13.

A platen 9 having a generally rectangular parallelepiped shape is disposed in an area surrounded by the sheet-convey belt 8. The platen 9 is held in contact with an inner surface of an upper portion of the sheet-convey belt 8, which upper portion faces the ink-jet heads 2, whereby the platen 9 supports the sheet-convey belt 8 from an inner side thereof. Thus, as shown in FIG. 1, there is formed a space defined between an outer surface of the upper portion of the sheet-convey belt 8 and lower surfaces of the ink-jet heads 2.

Figure 2:
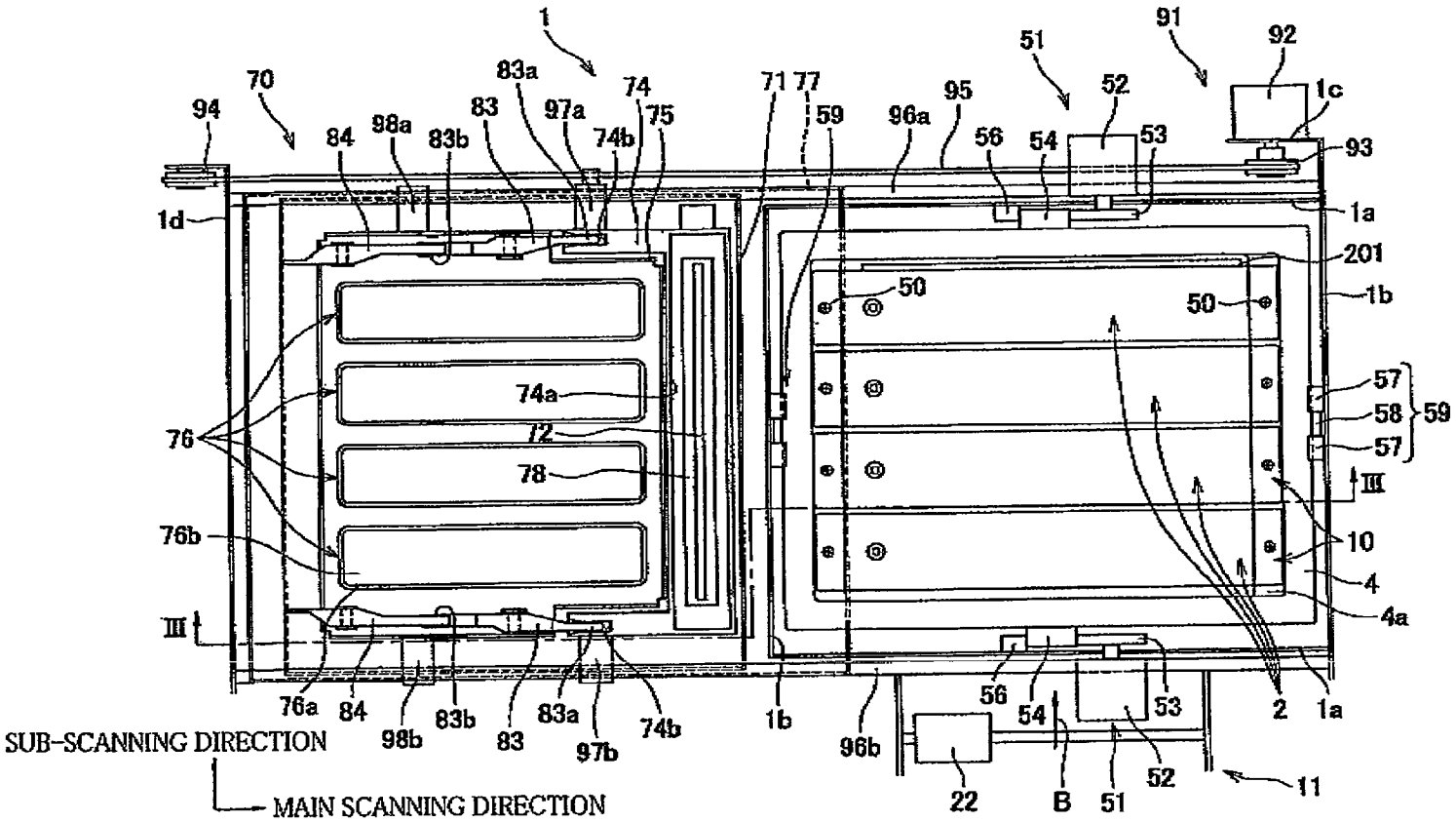
FIG. 2 is a plan view partially showing the ink-jet printer.
Figure 3:
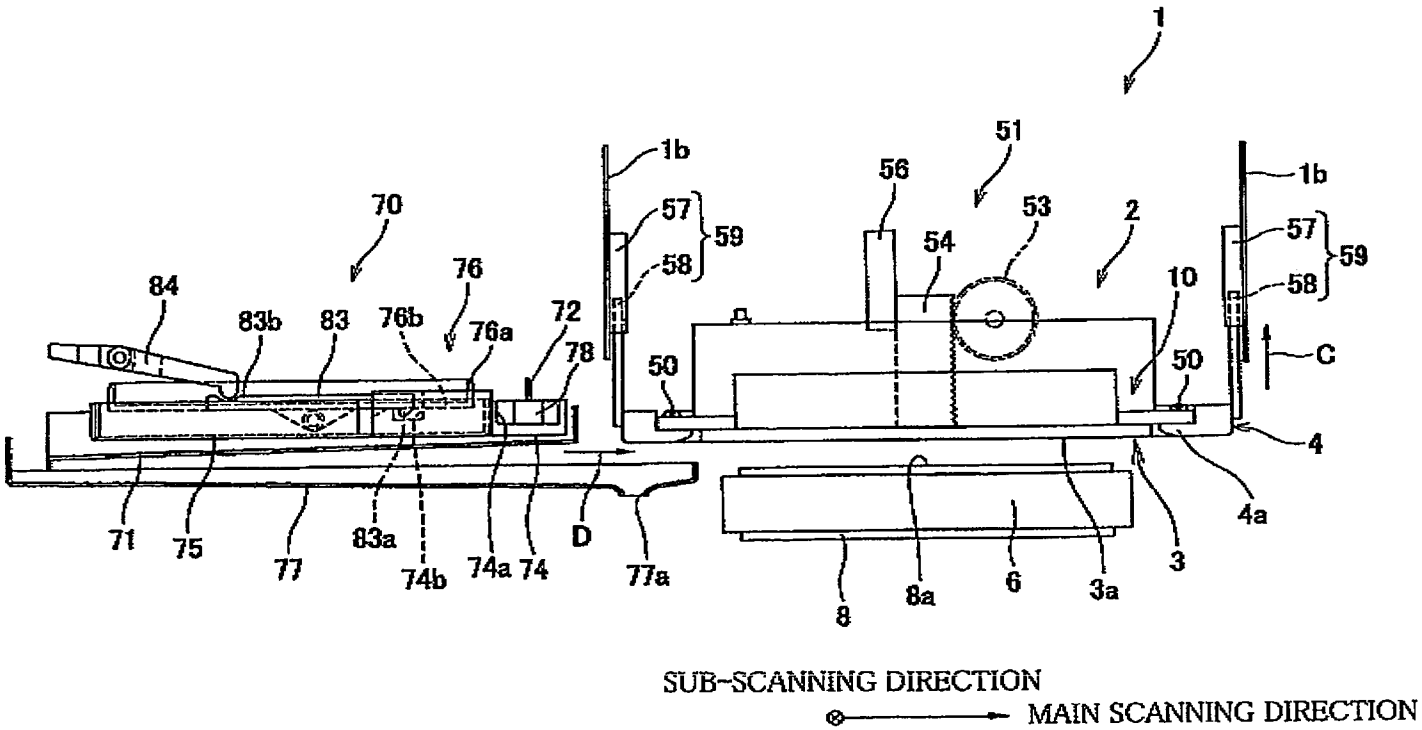
FIG. 3 is a cross-sectional view taken along a line III-III in FIG. 2.

As shown in FIG. 2, each of the four ink-jet heads 2 extends in a main scanning direction which is perpendicular to the sheet surface of FIG. 1. The ink-jet heads 2 are arranged in a sub-scanning direction which is perpendicular to the main scanning direction and coincides with the sheet-convey direction B. That is, the ink-jet printer 1 is a line-type printer in which is provided an ink ejection area extending in an ejection-area extending direction that is perpendicular to the sheet-convey direction B. As shown in FIGS. 1 and 3, each of the ink-jet heads 2 has, at a lower end thereof, a corresponding one of head bodies 3. Each of the head bodies 3 includes an ink channel unit and an actuator fixed to each other. The ink channel unit includes a plurality of individual ink channels including pressure chambers, and the actuator applies the inks in the pressure chambers. Each head body 3 has a rectangular parallelepiped shape elongated in the main scanning direction. In a lower surface of each head body 3, that is, an ejection surface 3*a* of each head body 3, there are provided and arranged a large number of ejection openings 3*b* (shown in FIG. 4) which are fine openings each for ejecting the inks and each as one end of a corresponding one of nozzles.

As shown in FIGS. 1 and 3, reservoir units 10 for temporarily storing the respective inks are fixed to respective upper surfaces of the head bodies 3. Each of the reservoir units 10 is longer than a corresponding one of the head bodies 3 and projected from opposite ends of the corresponding head body 3 in a longitudinal direction thereof. The reservoir units 10 are fixed, at the projected portions thereof, to a frame 4 having a rectangular opening such that the ejection surfaces 3*a* can be seen through the opening from a lower side of the ejection surfaces 3*a*. More specifically, a pair of flanges 4*a* each of which supports a corresponding one of opposite ends of the reservoir units 10 from lower sides thereof are projected from respective opposite end portions of the frame 4 toward a middle portion of the opening in a longitudinal direction thereof. The flanges 4*a* and longitudinal end portions of each reservoir unit 10 are fixed to each other by screws 50. The ejection surfaces 3*a* are the same in height as a bottom surface of the frame 4.

The head bodies 3 are disposed such that the ejection surfaces 3*a* face and are parallel to a portion of the sheet-convey belt 8 which is supported by the platen 9 and such that the small space or clearance is formed between the ejection surface 3*a* and the sheet-convey belt 8. The small space constitutes a part of the sheet-convey path. When the recording sheet is conveyed on the outer peripheral surface 8*a* just under the four head bodies 3 in order, the inks of the four colors are ejected toward an upper surface or a print surface of the conveyed recording sheet, whereby a desired color image is recorded on the recording sheet.

In this ink-jet printer 1, an image sensor 201 is attached to a downstream side face of one of the ink-jet heads 2 which is located at the most downstream position. A detailed explanation of the image sensor 201 will be described below.

Raising and Lowering Mechanisms

As shown in FIGS. 2 and 3, the frame 4 is supported by a pair of raising and lowering mechanisms 51 provided in the ink-jet printer 1, so as to be movable in a vertical direction. The pair of raising and lowering mechanisms 51 are disposed on both sides of the four ink-jet heads 2 in the sub-scanning direction. Each of the raising and lowering mechanisms 51 includes a head motor 52 as a drive source for moving the frame 4 in the vertical direction, a pinion gear 53 fixed to a shaft of the head motors 52, a rack gear 54 meshed with the pinion gear 53, and a guide 56 disposed at a position at which the rack gear 54 is interposed between the pinion gears 53 and the guide 56. As will be described below, the raising and lowering mechanisms 51 are driven on the basis of a control of the controller 101.

The head motors 52 included in the respective raising and lowering mechanisms 51 are respectively fixed to a pair of body frames 1*a* of the ink-jet printer 1. The pair of body frames 1*a* are disposed so as to face each other in the sub-scanning direction. The rack gears 54 extend in the vertical direction and are fixed, at lower ends thereof, to respective opposed side faces of the frame 4. Each of the rack gears 54 slidably contacts with a corresponding one of the guides 56 at one of opposed side faces of each rack gear 54, which one is opposite to the other that is mashed with a corresponding one of the pinion gear 53. The guides 56 are fixed to the respective body frames 1*a*.

When the pinion gears 53 are rotated forwardly or reversely with the two head motors 52 synchronized with each other, the rack gears 54 are moved upward or downward. With the movement of the rack gears 54, the frame 4 is moved upward or downward in the vertical direction together with the four ink-jet heads 2.

A pair of guide units 59 are disposed on respective opposed side faces of the frame 4 which extend in the sub-scanning direction. Each of the guide units 59 includes a bar 58 and a pair of guides 57 between which the bar 58 is interposed. As shown in FIG. 3, the two pairs of guides 57 extend in the vertical direction, and each of the pairs is fixed to a corresponding one of a pair of body frames 1*b* of the ink-jet printer 1. The pair of body frames 1*b* are disposed so as to face each other in the main scanning direction. The bars 68 extend in the vertical direction like the guides 57 and are respectively fixed to the side faces of the frame 4 which respectively face the body frames 1*b*. Each of the bar 58 is slidably contacted with a corresponding pair of the guides 57.

The guide units 69 prevent the ejection surfaces 3*a* from inclining with respect to the portion of the sheet-convey belt 8 which is supported by the platen 9, when the frame 4 is move upward and downward in the vertical direction by the raising and lowering mechanisms 51. That is, even when the frame 4 and the ink-jet heads 2 are moved upward and downward in the vertical direction by the raising and lowering mechanisms 51, the ejection surfaces 3*a* are always parallel to an upper surface of the platen 9. As a result, an ejected-ink-attaching accuracy upon recording can be improved.

Normally, the frame 4 is disposed at a recording position (where the frame 4 is located in FIG. 3) at which the ink-jet heads 2 eject the inks onto the recording sheet for the recording, by being moved by the raising and lowering mechanisms 51 in a direction indicated by arrow C in FIG. 3. Only when the ink-jet heads 2 are subjected to a maintenance operation such as a purging operation in which the inks are forced to be ejected from the ink-jet heads 2, a wiping operation in which the inks adhering to the ejection surfaces 3*a* are wiped, and a covering operation in which the ejection surfaces 3*a* are covered or capped by caps, the frame 4 is moved in the direction indicated by the arrow C in FIG. 3 by the raising and lowering mechanisms 51, so as to be disposed at a maintenance position at which the four ink-jet heads 2 are above the height level of the recording position.

Image Sensor

Figure 4:
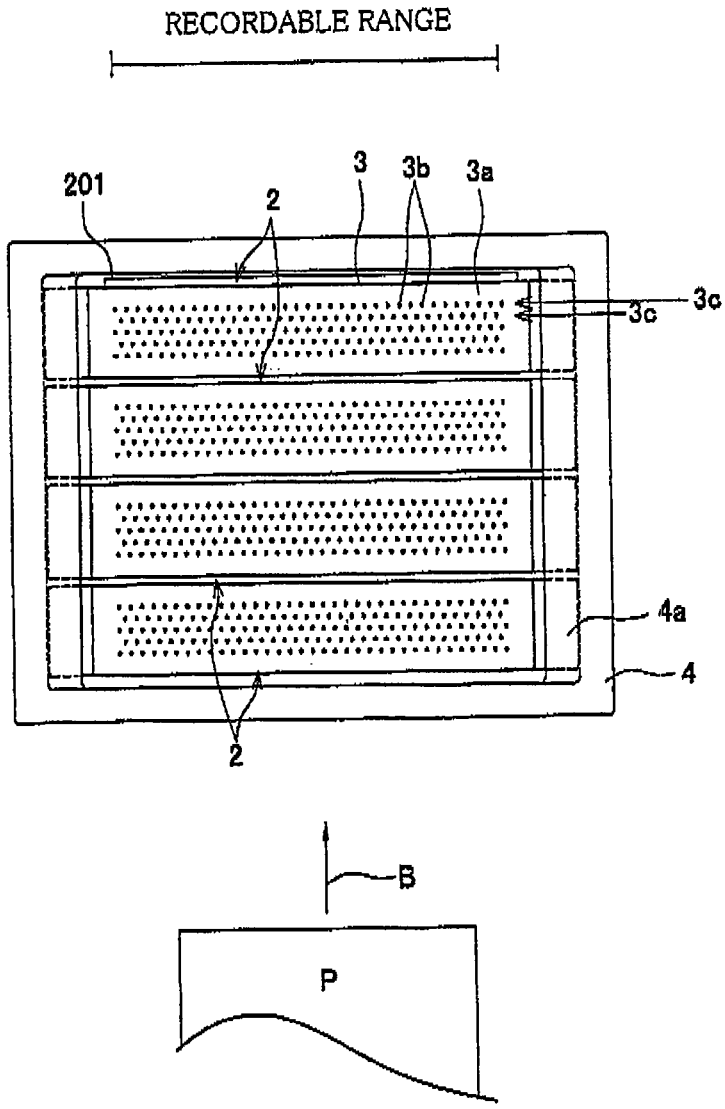
FIG. 4 is a bottom view showing four ink-jet heads of the ink-jet printer.

Here, there will be explained, with reference to FIG. 4, a positional relationship among the ink-jet heads 2, the image 201, and the recording sheet. As shown in FIG. 4, the plurality of ejection openings 3*b* which are the fine openings each as the one end of the nozzle are formed in the ejection surfaces 3*a*. In the ejection sources 3*a*, there are formed a plurality of nozzle rows (ejection openings rows) 3*c* each of which is constituted by ones of the ejection openings 3*b* that are arranged so as to be equally spaced from each other in the main scanning direction. The plurality of nozzle rows 3*c* are parallel to each other. Any of the ejection openings 3*b* formed in each of the ink-jet heads 2 is not located at the same positions as the other of the ejection openings 3*b* in the main scanning direction. The ejection openings 3*b* formed in each ink-jet head 2 are arranged so as to be equally spaced from each other in the main scanning direction.

The image sensor 201 is attached to the downstream side face of the one of the ink-jet heads 2 which is located at the most downstream position in the sub-scanning direction. That is, the image sensor 201 is integral with the one of the ink-jet heads 2. Thus, the image sensor 201 is movable by the driving of the raising and lowering mechanisms 51 together with the four ink-jet heads 2 and the frame 4. The image sensor 201 is disposed so as to be corresponded to a space formed between the frame 4 and the one of the ink-jet heads 2 which is located at the most downstream position in the sub-scanning direction. Thus, a lower surface of the image sensor 201 faces the outer peripheral surface 8*a* of the sheet-convey belt 8 without being intercepted by the frame 4.

In this ink-jet printer 1, the image sensor 201 has a pickup range extending in the main scanning direction, that is, extending in a direction the same as the ejection-area extending direction. That is, the image sensor 201 is of a line type. The pickup range is equal to, in the main scanning direction, an image-recordable range of the ink-jet heads 2 in which the ink-jet heads 2 can record the image on the recording sheet. Meanwhile, a width of a recording sheet P conveyed through the sheet-convey path (i.e., a length of the recording sheet P in the main scanning direction) is somewhat smaller than the image-recordable range of the ink-jet heads 2. Accordingly, even when the recording sheet P is conveyed in a state in which the recording sheet P is slightly shifted in a widthwise direction thereof, the image sensor 201 can perform an image-pickup operation for the recording sheet P in its full width. As will be described below, the image sensor 201 is used for detecting, by performing the image-pickup operation for the recording sheet, an ink ejection failure and a position of the recording sheet conveyed by the sheet-convey belt 8.

Figure 5:
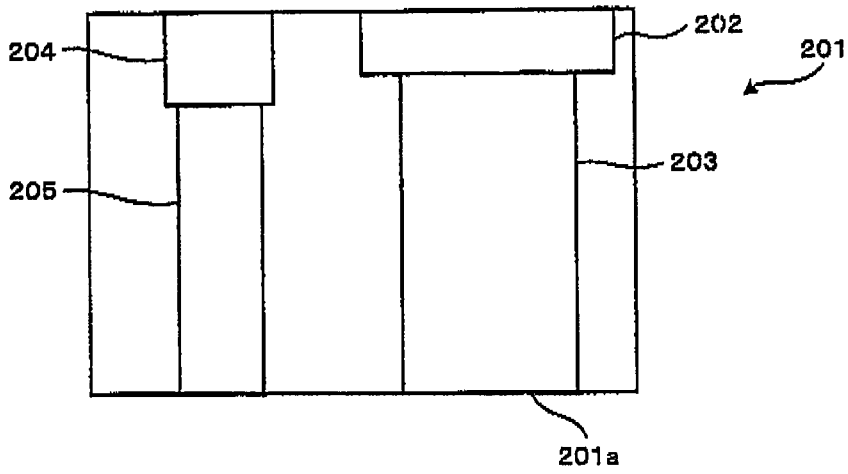
FIG. 5 is a cross-sectional view schematically showing an image sensor of the ink-jet printer.

As shown in FIG. 5, the image sensor 201 includes an image-pickup element 202, an image-forming optical system 203, an LED (a light-emitting diode) 204, and a light guide 206. The image-pickup element 202 is provided by a CCD or a CMOS, for example. The image-forming optical system 203 is provided between the image-pickup element 202 and a light-entering surface 201*a* as a lower surface of the image sensor 201 which faces the outer peripheral surface 8*a* of the sheet-convey belt 8. The image-forming optical system 203 guides, to the image-pickup element 202, a light entered through the light-entering surface 201*a* and is for forming, on the image-pickup element 202, an optical image of an object (in this ink-jet printer 1, the recording sheet conveyed by the sheet-convey belt 8 and the image recorded on the recording sheet). The LED 204 is a source of light with which the object is irradiated. The light guide 205 guides the light emitted from the LED 204 such that the light is emitted from the light-entering surface 201*a* toward the object. Each of the image-pickup element 202, the image-forming optical system 203, the LED 204, and the light guide 205 extends in the main scanning direction.

In this ink-jet printer 1, the ejection surfaces 3*a* of the respective ink-jet heads 2 and the reading surface 201*a* of the image sensor 201 is the same in height. When the frame 4 is located at an inspecting position, a distance to the ejection surfaces 3*a* and the reading surface 201*a* from the recording sheet which has a predetermined thickness and which is placed on the outer peripheral surface 8*a* is predetermined such that an optical image of the image recorded on the recording sheet is formed on the image-pickup element 202 by the image-forming optical system 203 of the image sensor 201, that is, such that an image based on image data obtained when the image sensor 201 performs the image-pickup operation for the recording sheet placed on the outer peripheral surface 8*a* is a focused image.

Structure of Maintenance Unit

There will be explained, with reference to FIGS. 2 and 3, a maintenance unit 70 for performing the maintenance operation for the ink-jet heads 2. As shown in the figures, the maintenance unit 70 is disposed in a left side of the ink-jet heads 2. The maintenance unit 70 includes two trays 71, 75 movable horizontally. The tray 71 has a generally square box-like shape having an opening opened upward. The tray 71 encloses the tray 75. In other words, the tray 75 is in the tray 71. The tray 71 and the tray 75 are connectable to and disconnectable from each other. A state in which the tray 71 and the tray 75 are connected to each other and a state in which the tray 71 and the tray 75 are disconnected from each other are changeable on the basis of whether recessed portions 74*b* and projecting portions 83*a* which will be described below are engaged with each other or disengaged from each other.

When the maintenance unit 70 is horizontally moved toward a right side thereof, the frame 4 is moved upward to the maintenance position in advance in the direction indicated by the arrow C in FIG. 3, so that the space for the maintenance unit 70 is assured between the four ejection surfaces 3*a* and the sheet-convey belt 8. Thereafter, the maintenance unit 70 is horizontally moved in a direction indicated by arrow D in FIG. 3. One of side faces of the tray 71 which is further from the ink-jet heads 2 is opened, so that when the recessed portions 74*b* and the projecting portions 83*a* are disengaged from each other (in the purging operation, for example), only the tray 71 is horizontally moved rightward with the enclosed tray 75 remaining at its original position.

A waste-ink receiving tray 77 is disposed just below the maintenance unit 70. The waste-ink receiving tray 77 has a size enclosing the tray 71 in plan view. Even when the tray 71 is moved to an right end of the ink-jet printer 1 in FIG. 2, the waste-ink receiving tray 77 overlaps with one of opposite end portions of the tray 71, which one is located on an opposite side of the ink-jet heads 2. An ink-discharge opening 77*a* is formed in one of opposite end portions of the waste-ink receiving tray 77 which one is nearer to the ink-jet heads 2. The ink-discharge opening 77*a* guides or discharges, to a waste-ink accumulating portion (not shown), the ink flown onto the waste-ink receiving tray 77.

A wiper 72 and the tray 75 are disposed in the tray 71 with the wiper 72 located nearer to the ink-jet heads 2 than the tray 75. In the tray 75, four caps 76 each having a rectangular shape in plan view are arranged side by side in correspondence with the respective ink-jet heads 2. A longitudinal direction of the caps 76 is parallel to a longitudinal direction of the ink-jet heads 2. The caps 76 are disposed in the sub-scanning direction with pitches which are the same as pitches with which the ink-jet heads 2 are disposed in the sub-scanning direction.

Each of the caps 76 includes a plate-like member 76*b* and a circular projection 76*a*. Each plate-like member 76*b* has, in plan view, a rectangular shape which is substantially the same size as a corresponding one of the ejection surfaces 3*a*, and each circular projection 76*a* projects upward from a peripheral portion of a corresponding one of the plate-like members 76*b*. Each circular projection 76*a* is formed of an elastic material such as rubber and has a size and a shape in which each circular projection 76*a* faces a peripheral portion of a corresponding one of the ejection surfaces 3*a*. Each cap 76 defines an air-tight space when the corresponding circular projection 76*a* contacts with the peripheral portion of the corresponding ejection surface 3*a*. In this manner, each cap 76 can cover the corresponding ejection surface 3*a*. The caps 76 are forced upward by two springs (not shown) while being supported by a bottom surface of the tray 75.

To the tray 71, there are fixed, in addition to the wiper 72, a holding member 74 on which a mount member 78 is disposed. The holding member 74 has a three-sided rectangular shape in plan view. A groove 74*a* extending in the sub-scanning direction is formed in an upper surface of a portion of the holding member 74 which extends in the sub-scanning direction. In the groove 74*a*, the mount member 78 and the wiper 72 are disposed. The above-described recessed portions 74*b* are respectively formed in respective upper surfaces of two portions of the holding member 74 which extend in the main scanning direction.

The wiper 72 is formed of an elastic material such as rubber. The wiper 72 has a length slightly larger than an entire width of the four ink-jet heads 2 in the sub-scanning direction and is fixed to the mount member 78 such that a longitudinal direction of the wiper 72 coincides with the sub-scanning direction. The mount member 78 has a rectangular parallelepiped shape which extends in the sub-scanning direction like the wiper 72.

The recessed portions 74*b* and hooking members 83 are respectively provided near opposite ends of the trays 71, 75. Each of the hooking members 83 extends in the main scanning direction and is pivotable about a central portion thereof. Each of the projecting portions 83*a* is provided on one of opposite end portions of a corresponding one of the hooking members 83, which one is nearer to the ink-jet heads 2. When the hooking members 83 are pivoted in a clockwise direction in FIG. 3, the projecting portions 83*a* are respectively engaged with the recessed portions 74*b*. Above the maintenance unit 70, contacting members 84 are disposed in correspondence with the respective two hooking members 83. The state in which the tray 71 and the tray 75 are connected to each other and the state in which the tray 71 and the tray 75 are disconnected from each other are changeable on the basis of whether recessed portions 74*b* and projecting portions 83*a* which will be described below are engaged with each other or disengaged from each other.

The contacting members 84 are supported so as to be pivotable. When each of the contacting members 84 is pivoted in the clockwise direction in FIG. 3, one of opposite ends of each contacting member 84 is brought into contact with the other end portion 83*b* of a corresponding one of the hooking members 83. When the contacting members 84 are further pivoted in the clockwise direction in FIG. 3, the hooking members 83 are pivoted in a counterclockwise direction in FIG. 3, whereby the projecting portions 83*a* and the respective recessed portions 74*b* are disengaged from each other. On the other hand, when the contacting members 84 are pivoted in the counterclockwise direction in FIG. 3 to move away from the other end portions 83*b*, the projecting portions 83*a* and the respective recessed portions 74*b* are engaged with each other by own weights of the respective hooking members 83.

When the maintenance operation of the ink-jet heads 2 is not performed, the maintenance unit 70 is, as show in FIGS. 2 and 3, at rest at a retracted position at which the maintenance unit 70 does not face the ink-jet heads 2. When the maintenance operation is performed, the maintenance unit 70 is horizontally moved from the retracted position to a maintenance position at which the maintenance unit 70 faces the ejection surfaces 3*a* of the respective ink-jet heads 2. In this movement, distal ends of the wiper 72 and the caps 76 are not brought into contact with the ejection surfaces 3*a* because the frame 4 is disposed at the maintenance position.

It is noted that even when the maintenance operation is performed, only the tray 71 is moved, in the purging operation, from the retracted position to the maintenance position to receive the discharged inks, with the tray 75 remaining at its original position. When the ejection surfaces 3*a* are covered by the respective caps 76, the tray 71 and the tray 75 are connected to each other by the engagement of the recessed portions 74*b* and the respective projecting portions 83*a*, thereby moving the maintenance unit 70 to a position at which the caps 76 and the ejection surface 3*a* are respectively face each other.

The trays 71, 75 are slidably supported by a pair of guide shafts 96*a*, 96*b* extending in the main scanning direction, Two bearing members 97*a*, 97*b* are provided on the tray 71. The bearing members 97*a*, 97*b* are projected from respective opposed outside faces of the holding member 74. Two bearing members 98*a*, 98*b* are provided on the tray 75. The bearing members 98*a*, 98*b* are projected from respective opposite side faces of the tray 75. Each of the pair of guide shafts 96*a*, 96*b* is fixed, at opposite ends thereof, to the body frames 1*b*, 1*d*. The pair of guide shafts 96*a*, 96*b* are disposed between the body frames 1*b*, 1*d* so as to be parallel to each other.

Here, there will be explained a horizontally moving mechanism 91 for horizontally moving the trays 71, 75 along the guide shafts 96*a*, 96*b* in the direction indicated by the arrow D. As shown in FIG. 2, the horizontally moving mechanism 91 includes a tray motor 92, a motor pulley 93, an idle pulley 94, a timing belt 95, the guide shafts 96*a*, 96*b*, and so on.

The tray motor 92 is fixed to a mount portion 1*c* formed at one of end portions of the body frames 1*b* extending in the sub-scanning direction. The motor pulley 93 is connected to the tray motor 92, and rotated in accordance with driving of the tray motor 92. The idle pulley 94 is rotatably supported by a body frame 1*d* located at the most left side of the ink-jet printer 1 in FIG. 2. The timing belt 95 is disposed so as to be parallel to the guide shaft 96*a* and wound around the motor pulley 93 and the idle pulley 94 to bridge the motor pulley 93 and the idle pulley 94. The timing belt 95 is connected to the bearing member 97*a* provided on the holding member 74.

In this construction, when the tray motor 92 is driven, the timing belt 95 is moved in accordance with forward and reverse rotations of the motor pulley 93. By the movement of the timing belt 95, the tray 71 connected to the timing belt 95 via the bearing member 97*a* is horizontally moved. In a state in which the recessed portions 74*b* and the projecting portions 83*a* are respectively engaged with each other, the wiper 72 in the tray 71 and the caps 76 in the tray 75 are moved together with each other. On the other hand, in a state in which the projecting portions 83*a* and the recessed portions 74*b* are not engaged with each other, only the wiper 72 in the tray 71 is moved.

Controlling System

Figure 6:
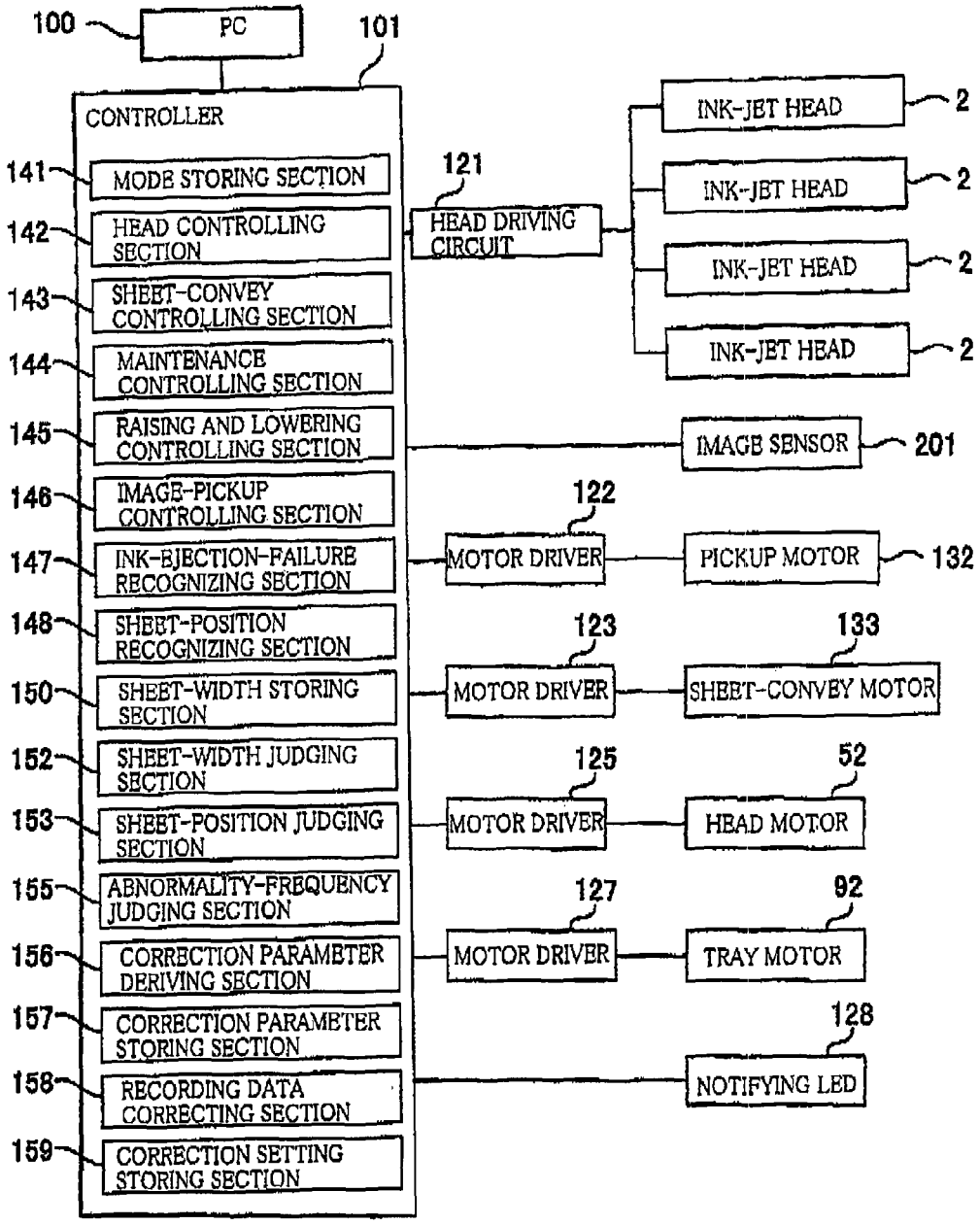
FIG. 6 is a block diagram showing the ink-jet printer.

There will be next explained a controlling system of the ink-jet printer 1 with reference to FIG. 6. The ink-jet printer 1 includes the controller 101 configured to execute controls for operations of the ink-jet printer 1. The controller 101 includes a Central Processing Unit (CPU), a Read Only Memory (ROM), and a Random Access Memory (RAM). The CPU functions as an arithmetic processing unit, the ROM stores controlling programs executed by the CPU and data used for the controlling programs, and the RAM is for temporarily storing data when the programs are executed. The CPU, the ROM, and the RAM function as a mode storing section 141, a head controlling section 142, a sheet-convey controlling section 143, a maintenance controlling section 144, a raising and lowering controlling section 145, an image-pickup controlling section 146, an ink-ejection-failure recognizing section (a liquid-ejection-failure recognizing section) 147, a sheet-position recognizing section (a medium-position recognizing section) 148, a sheet-width storing section (a medium-width storing section) 150, a sheet-width judging section (a medium-width judging section) 152, a sheet-position judging section (a medium-position judging section) 163, an abnormality-frequency judging section 155, a correction parameter deriving section 156, a correction parameter storing section 157, a recording data correcting section 158, the correction setting storing section 159, and so on.

The mode storing section 141 stores whether the ink-jet printer 1 is in a normal recording mode or an inspecting mode, and indicates, as a mode indicating section, one of the normal recording mode and the inspecting mode. Here, the normal recording mode is a mode in which a desired image is recorded on the recording sheet, and the inspecting mode is a mode for detecting the ink ejection failure and a sheet conveying failure by the image-pickup operation of the image sensor 201, i.e., by picking up, by the image sensor 201, the recording sheet conveyed by the sheet-convey belt 8 and the image recorded on the recording sheet. In this ink-jet printer 1, the inspecting mode is set to be established in advance of the normal recording mode in which recording is performed on a plurality of the recording sheet using common recording data. Information stored in the mode storing section 141 is automatically changed to information indicating the normal recording mode when the number of the recording in the inspecting mode exceeds a predetermined number. In addition, the information stored in the mode storing section 141 is changed from the information indicating the normal recording mode to information indicating the inspecting mode and vice versa, by a signal transmitted from a personal computer CPC) 100 on the basis of an operation of a user. As a modification, there may be provided, instead of the mode storing section 141, an analog circuit in which a level of an outputted signal varies in accordance with whether the ink-jet printer 1 is in the normal recording mode or the inspecting mode. In short, a means or the like which indicates whether the ink-jet printer 1 is in the normal recording mode or the inspecting mode needs only to be provided.

The head controlling section 142 controls a head driving circuit 121 such that the inks are ejected, on the basis of a recording data received from the PC 100, by one or ones of the ink-jet heads 2 which is or are corresponded to the received recording data.

When the ink-jet printer 1 is in the normal recording mode, the sheet-convey controlling section 143 controls a motor driver 122 such that the uppermost one of the recording sheets in the sheet tray 21 is conveyed onto the sheet-convey belt 8 by rotating of the pickup roller 22 which is caused by driving of the pickup motor 182, and controls a motor driver 123 such that the recording sheet is conveyed while being held on the outer peripheral surface 8*a* by the rotating of the belt roller 6 which is caused by driving of the sheet-convey motor 133. Further, the sheet-convey controlling section 143 controls the motor driver 123 such that the rotation of the belt roller 6 is stopped by stopping the driving of the sheet-convey motor 133 after the recording sheet on the sheet-convey belt 8 has reached the sheet-discharge portion 12. When the ink-jet printer 1 is in the inspecting mode, the sheet-convey controlling section 143 executes the same control as in the normal recording mode.

The maintenance controlling section 144 controls the maintenance unit 70. Specifically, the maintenance controlling section 144 controls a motor driver 127 such that the tray 71 is horizontally moved from the retracted position to the maintenance position by the driving of the tray motor 92 when the inks are initially introduced into the ink-jet heads 2, and when the purging operation is performed. Further, the maintenance controlling section 144 controls the motor driver 127 such that the tray 71 is horizontally moved from the maintenance position to the retracted position by the driving of the tray motor 92 when the purging operation is finished. Furthermore, the maintenance controlling section 144 controls the motor driver 127 such that the trays 71, 75 are horizontally moved from the retracted positions to their capping positions by the driving of the tray motor 92 when the ejection surfaces 3*a* are covered or capped. Furthermore, the maintenance controlling section 144 controls the motor driver 127 such that the trays 71, 75 are horizontally moved from the capping positions to the retracted positions by the driving of the tray motor 92 when the recording data has been received from the PC 100. Furthermore, the maintenance controlling section 144 controls a pump driver (not shown) such that the inks in respective ink cartridges (not shown) are forced to be respectively sent to the head bodies 3 by pumps (not shown) when the inks are initially introduced into the ink-jet heads 2, and when the purging operation is performed.

The raising and lowering controlling section 145 changes a height of the frame 4 and the four ink-jet heads 2 by controlling the raising and lowering mechanisms 51. Specifically, the raising and lowering controlling section 145 controls a motor driver 125 which is a portion of the raising and lowering mechanisms 51 and which drives the head motors 52 shown in FIG. 2. In the normal recording mode, the raising and lowering controlling section 145 controls the motor driver 125 such that the frame 4 is located at the maintenance position when the inks are initially introduced into the ink-jet heads 2, and when the maintenance operation of the ink-jet heads 2 is performed. Further, in the normal recording mode, the raising and lowering controlling section 145 controls the motor driver 125 such that the frame 4 is located at the recording position when the image is recorded on the recording sheet. Furthermore, in the inspecting mode, the raising and lowering controlling section 145 controls the motor driver 125 such that the frame 4 is located at the recording position.

The image-pickup controlling section 146 controls the image sensor 201 such that the image sensor 201 performs the image-pickup operation for the recording sheet placed on the outer peripheral surface 8*a* of the sheet-convey belt 8 and the image recorded on the recording sheet when the ink-jet printer 1 is in the inspecting mode. Image data obtained by this image-pickup operation of the image sensor 201 is analyzed by the ink-ejection-failure recognizing section 147 and the sheet-position recognizing section 148.

The ink-ejection-failure recognizing section 147 recognizes, for each of the ejection openings 3*b*, presence and absence of the ink ejection failure of the ink-jet heads 2 on the basis of a portion of image data obtained by the image-pickup operation of the image sensor 201, which portion corresponds to the image. Further, the ink-ejection-failure recognizing section 147 judges, on the basis of the recognition, presence and absence of requirement of performing the maintenance operation of the ink-jet heads 2. Here, the ink ejection failure includes non-ejection of the inks, variation of an ejected ink amount, and a deviation of a direction in which the inks are ejected.

The sheet-position recognizing section 148 recognizes a position of the recording sheet conveyed or being conveyed by the sheet-convey mechanism, which position is relative to the ink-jet heads 2, on the basis of a portion of the image data obtained by the image-pickup operation of the image sensor 201, which portion includes data corresponding to an outline of the recording sheet. That is, the sheet-position recognizing section 148 recognizes presence and absence of the sheet conveying failure of the sheet-convey mechanism on the basis of the portion of the image data. Specifically, the sheet-position recognizing section 148 recognizes an inclination angle of the recording sheet relative to the sheet-convey direction B and the position of the recording sheet in the ejection-area extending direction or a longitudinal direction of the ink ejection area of the ink-jet heads 2 (that is, the sheet-position recognizing section 148 recognizes a shift amount of the recording sheet in the main scanning direction). The shift amount of the recording sheet is recognized on the basis of a position or positions of one or both of pairs of opposite ends of the recording sheet in an image indicated by the image data. The inclination angle of the recording sheet is recognized on the basis of at least one of inclination angles of respective sides of the recording sheet in the image indicated by the image data.

Figure 7A:
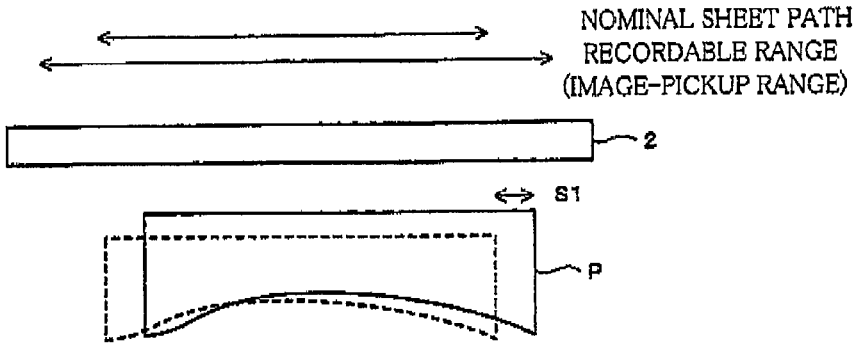
FIG. 7A is a view schematically showing that a recording sheet P is conveyed while shifted from a nominal position thereof.
Figure 7B:
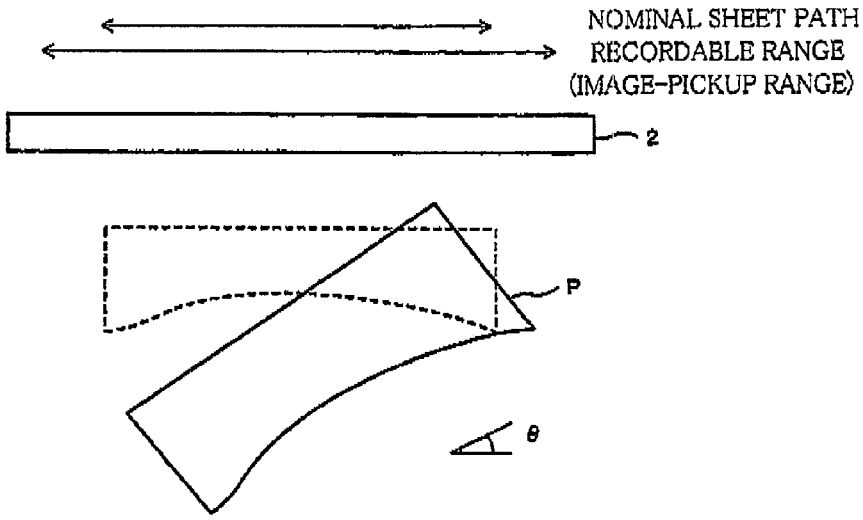
FIG. 7B is a view schematically showing that the recording sheet P is conveyed while inclined from the nominal position thereof.

As an example, FIG. 7A shows that a recording sheet P is conveyed while shifted in the main scanning direction by a shift amount S1 from a nominal position of the recording sheet P which is indicated by a broken line. The shift amount S1 is relatively small, and opposite ends of the recording sheet P is within a recordable range of the ink-jet heads 2, i.e., a range of the ink ejection area of the ink-jet heads 2 (which is equal to an pickup range of the image sensor 201, in this ink-jet printer 1). Further, FIG. 7B shows that the recording sheet P is conveyed while inclined counterclockwise by an inclination angle θ from the nominal position of the recording sheet P which is indicated by the broken line. The inclination angle θ is relatively small, and an entirety of the recording sheet P is within the recordable range, i.e., the range of the ink ejection area of the ink-jet heads 2 (which is equal to the pickup range of the image sensor 201, in this ink-jet printer 1).

As a modification, the sheet-position recognizing section 148 may have a function for recognizing, where the image data obtained by the image-pickup operation of the image sensor 201 does not include data corresponding to one of opposite end portions of the recording sheet, which end portions extend in the sheet-convey direction B, a position of the one of the opposite end portions and, as a result, the position of the recording sheet in the ejection-area extending direction on the basis of: data corresponding to the other of the opposite end portions in the image data obtained by the image-pickup operation of the image sensor; and data of a width of the recording sheet which is stored in the sheet-width storing section 150.

Figure 8:
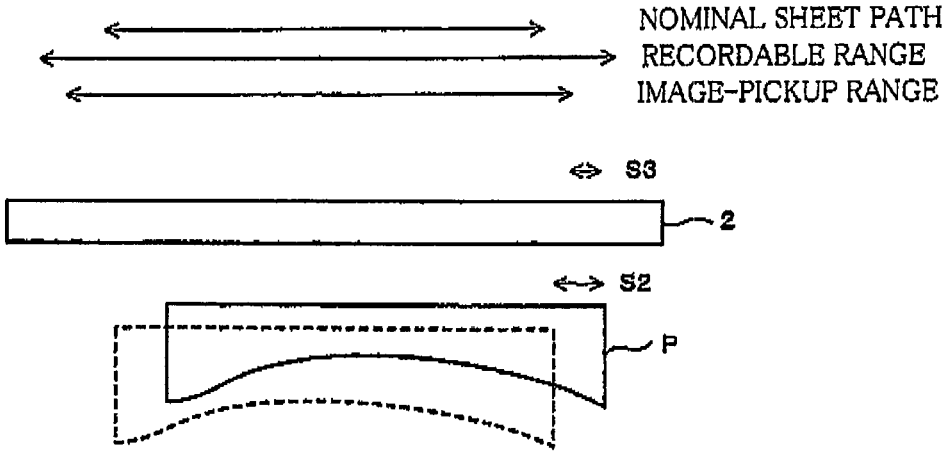
FIG. 8 is a view schematically showing that the recording sheet P is shifted from the nominal position, so as to be beyond a pickup range.

As an example, FIG. 8 shows that the recording sheet P is shifted from the nominal position thereof indicated by the broken line by the shift amount S2 in the main scanning direction. In this modification, the recordable range of the ink-jet heads 2 is wider than the pickup range of the image sensor 201. In this case, one of opposite ends of the recording sheet P (a right end in FIG. 8) is within the recordable range but is beyond the pickup range by a distance S3. The other of the opposite ends (a left end in FIG. 8) is within the pickup range. Accordingly, in this case, the sheet-position recognizing section 148 recognizes a position of the recording sheet P on the basis of the one end of the recording sheet P which is located within the pickup range and the data of the width of the recording sheet P which is stored in the sheet-width storing section 150. Consequently, even where the image sensor 201 is relatively short, the desired image can be properly recorded on the recording sheet P.

In this ink-jet printer 1, the sheet-position recognizing section 148 has a function (a width deriving function) for deriving, as a width deriving section, where the image data obtained by the image-pickup operation of the image sensor 201 includes data corresponding to both of opposite end portions of the recording sheet, which end portions extend in the sheet-convey direction B, the width of the recording sheet conveyed by the medium-convey mechanism on the basis of the data corresponding to the both of opposite end portions of the recording sheet.

The sheet-width judging section 152 judges whether (a) the width of the recording sheet which has been derived by the sheet-position recognizing section 148 and (b) the width of the recording sheet which is based on the data stored in the sheet-width storing section 150 coincide with each other. Where not coinciding, the sheet-width judging section 152 illuminates a notifying LED 128 connected to the controller 101. Further, the sheet-width judging section 152 detects a size relationship between the width of the recording sheet which has been derived by the sheet-position recognizing section 148 and the recording width of the image to be recorded on the basis of the recording data having been transmitted from the PC 100 (that is, the sheet-width judging section 152 detects whether the width and the recording width is the same as each other and detects which width is larger where the width and the recording width is different from each other). The data of the width of the recording sheet which is stored in the sheet-width storing section 150 may be inputted by an operator, for example.

In view of the above, the controller 101 can be considered to further include a notifying section configured to illuminate the notifying LED 128 connected to the controller 101 to notify the operator about a fact that the widths do not coincide with each other, and a size-relationship detecting section configured to detect the size relationship between the width of the recording sheet which has been derived by the sheet-position recognizing section 148 and the recording width of the image to be recorded on the basis of the recording data.

The sheet-position judging section 153 judges whether the position of the recording sheet which has been recognized by the sheet-position recognizing section 148 is normal or not. Here, the term "normal" means that each of the shift amount of the recording sheet and the inclination angle of the recording sheet is equal to zero or lower than a threshold that is extremely near zero, for example.

Further, the sheet-position judging section 153 judges whether the position of the recording sheet which has been recognized by recognizing section 148 (i.e., the shift amount and the inclination angle) is a position at which the image to be recorded on the recording medium on the basis of the recording data becomes proper where the recording data is corrected by the recording data correcting section 158. This judgment is performed on the basis of a relative positional relationship between the recordable range of the ink-jet heads 2 and the position of the recording sheet. It is noted that a term "the image to be recorded on the recording medium on the basis of the recording data becomes proper" means that the image is recorded without shift or inclination relative to the outline of the recording sheet and that any portion of the image is not located off the recording sheet where a non-margin recording operation is performed while a width of a margin enclosing the image is uniform where a margin recording operation is performed.

The abnormality-frequency judging section 155 judges whether the number of the recording sheets having been subjected to the recording consecutively in the inspecting mode reaches a predetermined number (which is "N", in this ink-jet printer 1). It is noted that, hereinafter, the number of the recording sheets having been subjected to the recording consecutively may be referred to as a consecutive recording number. Further, the abnormality-frequency judging section 155 judges, where the consecutive recording number has reached the predetermined number, whether the number of ones of the recording sheets of the number N having conveyed and been subjected to the recording in the inspecting mode, which ones have been recognized, by the sheet-position recognizing section 148, that the respective positions thereof are not normal is equal to or greater than a predetermined value (which is extremely near the number N). That is, in an instance where the recording sheets whose positions are not normal are defined as abnormal position sheets (media), the abnormality-frequency judging section judges whether a ratio of the number of the abnormal position sheets to the plurality of the recording sheets is equal to or greater than a threshold. Furthermore, the abnormality-frequency judging section 165 judges, where the number of the abnormal position sheets is equal to or greater than the predetermined value, whether the respective shift amounts or the respective inclination angles of all the abnormal position sheets are distributed over a specific small range.

Assuming that the recording sheet conveyed by the sheet-convey mechanism to the position facing the ink-jet heads 2 always has a certain shift amount or a certain inclination angle (that is, this ink-jet printer 1 has, in probability, a high repeatability of the shift amount and the inclination angle of the recording sheet), the correction parameter deriving section 156 derives a parameter relating to a correction which is to be made to recording data in order to compensate the certain shift amount or the certain inclination angle such that the image to be recorded on the recording sheet becomes proper (hereinafter, the parameter may be referred to as a "parameter A"). Here, the certain shift amount or the certain inclination angle corresponds to a representative value (e.g., a median value, a mode value, or an average value) of the fixed small range relating to the judgment of the abnormality-frequency judging section 155. For example, where the recording sheet is always shifted rightward by 5 mm, there is derived a correction parameter of the recording data for shifting the image to be recorded on the basis of the recording data rightward by 5 mm. As a result, the image is recorded on the recording sheet at a nominal position thereof. Further, where the recording sheet is always inclined clockwise by 15°, there is derived a correction parameter of the recording data for rotating the image to be recorded on the basis of the recording data clockwise by 15°, for example. As a result, the image is recorded on the recording sheet with no inclination. In these ways, the parameter A derived by the correction parameter deriving section 156 is stored in the correction parameter storing section 157.

Further, where the width of the recording sheet which has been derived by the sheet-position recognizing section 148 is smaller than the recording width of the image to be recorded on the basis of the recording data transmitted from the PC 100, the correction parameter deriving section 156, using the size relationship detected by the sheet-width judging section 152, derives a correction parameter of the recording data for reducing a size of the image to be recorded such that an entirety of the image is recorded on the recording sheet, or derives a correction parameter for deleting a portion of the image to be recorded, which portion is to be located off the recording medium. Which parameter is derived is judged by the correction parameter deriving section 156 on the basis of set information stored in the correction setting storing section 159. In this way, the correction parameter derived by the correction parameter deriving section 156 (hereinafter, the parameter may be referred to as a "parameter B") is stored in the correction parameter storing section 157. The parameter A and the parameter B do not conflict with each other but are derived as parameters independent of each other for the correction and then stored in the correction parameter storing section 157. It is noted that, where the width of the recording sheet which has been derived by the sheet-position recognizing section 148 is equal to or larger than the recording width of the image to be recorded on the basis of the recording data transmitted from the PC 100, the correction parameter deriving section 156 does not derive the correction parameter relating to a size of the image to be recorded on the basis of the recording data (i.e., the parameter B), that is, the correction parameter deriving section 156 does not correct the recording data as to the size of the image to be recorded. It is noted that information stored in the correction setting storing section 159 can be rewritten on the basis of an operation of the operator.

Figure 9:
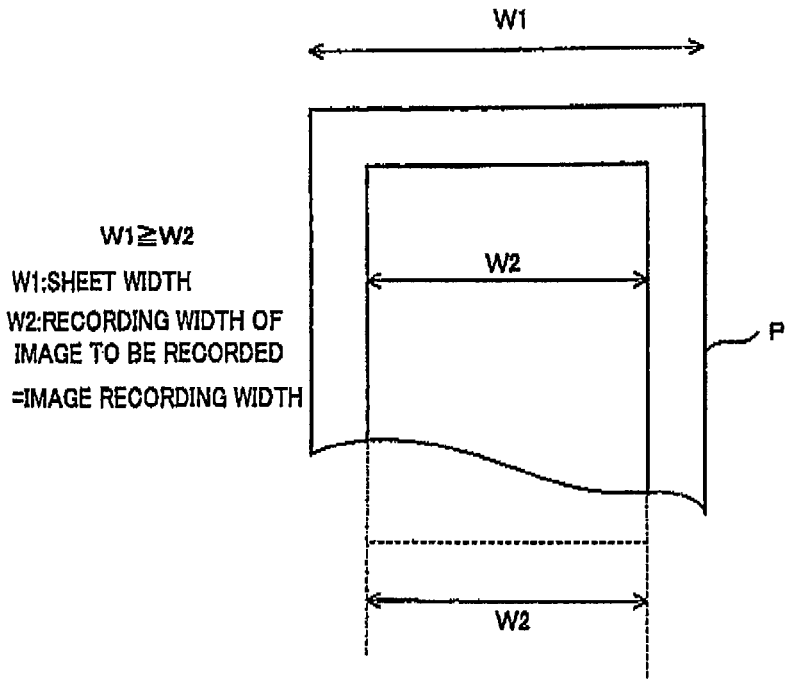
FIG. 9 is a view schematically showing a case in which a width W1 of the recording sheet is equal to or larger than a recording width W2 of an image to be recorded on the basis of image data.

FIG. 9 shows, as an example, a case in which a width W1 of the recording sheet which has been derived by the sheet-position recognizing section 148 is equal to or larger than a recording width W2 of the image to be recorded on the basis of the recording data which is transmitted from the PC 100. In this case, the correction parameter deriving section 156 does not derive the correction parameter relating to the size of the image to be recorded on the basis of the recording data (i.e., the parameter B).

Figure 10A:
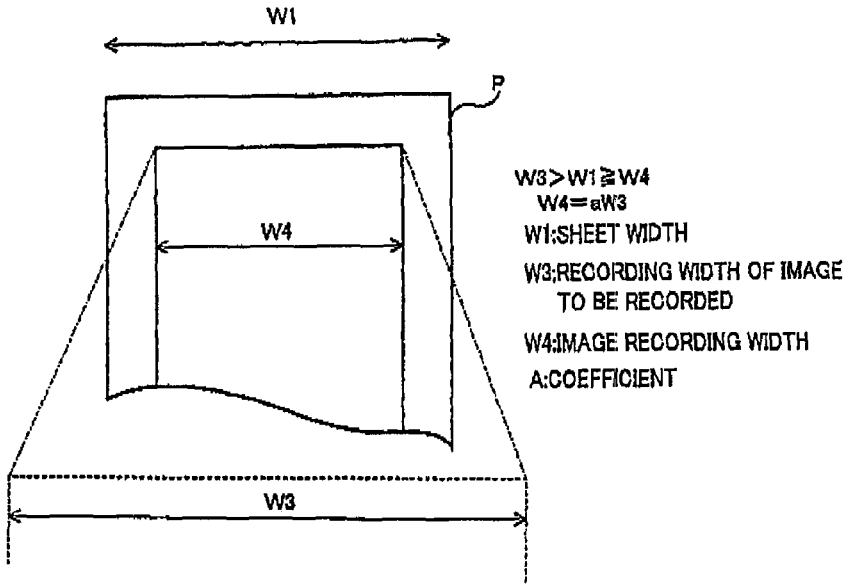
FIGS. 10A and 10B are views each schematically showing a case in which the width W1 of the recording sheet is smaller a recording width W3 of an image to be recorded on the basis of the image data.

There will be explained, with reference to FIG. 10A, the correction parameter, derived by the correction parameter deriving section 156, for reducing the size of the image to be recorded such that the entirety of the image is recorded on the recording sheet, where the width W1 of the recording sheet which has been derived by the sheet-position recognizing section 148 is smaller than a recording width W3 of the image to be recorded on the basis of the recording data. The correction parameter derived in this example is a coefficient A given when a product of the recording width W3 and the coefficient A is equal to an image recording width W4 set to be an appropriate size smaller than the width W1 of the recording sheet.

Figure 10B:
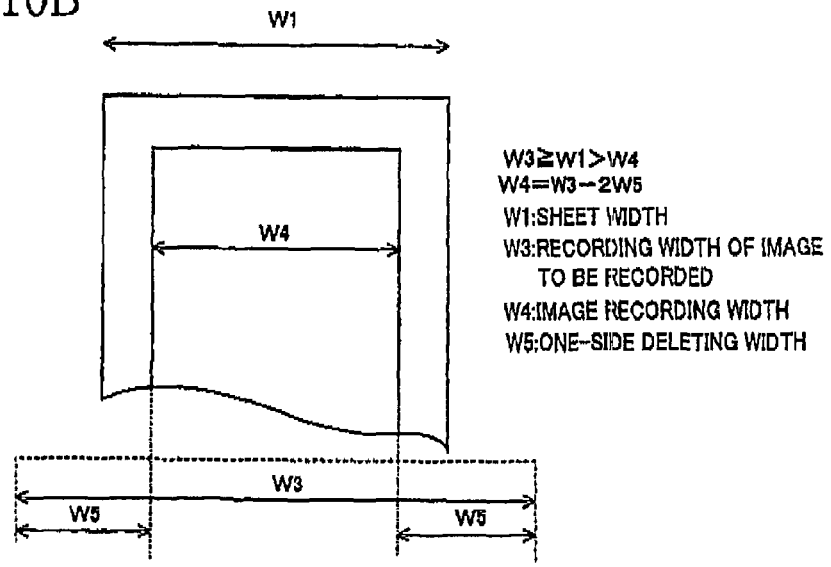

Further, there will be explained, with reference to FIG. 10B, the correction parameter, derived by the correction parameter deriving section 156, for deleting the portion of the image to be recorded, which portion is to be located off the recording sheet, where the width W1 of the recording sheet which has been derived by the sheet-position recognizing section 148 is smaller than the recording width W3 of the image to be recorded on the basis of the recording data. The correction parameter derived in this example is a quotient W5 given by dividing a value by two, which value is obtained by subtracting, from the recording width W3, the image recording width W4 set to be the appropriate size smaller than the width W1 of the recording sheet.

The recording data correcting section 158 corrects, where the sheet-position judging section 153 has judged that the position of the recording sheet is not normal, that is, the recording sheet is the abnormal position sheet, the recording data such that the image to be recorded on the recording medium on the basis of the recording data becomes proper. More specifically, the recording data correcting section 158 corrects, in the normal recording mode, the recording data on the basis of the correction parameters (the parameter A and the parameter B) stored in the correction parameter storing section 157 such that the image to be recorded on the recording medium on the basis of the recording data becomes proper. That is, the recording data correcting section 158 corrects the recording data such that the image to be recorded on the recording sheet is not inclined, on the basis of the inclination angle of the recording sheet which is recognized by the sheet-position recognizing section 148, and corrects, on the basis of the position of the recording sheet which has been recognized by the sheet-position recognizing section 148, the recording data such that the image to be recorded on the recording sheet is shifted in the ejection-area extending direction. Thus, the recording is performed on the basis of the corrected recording data, whereby the image to be recorded on the recording sheet becomes proper.

It is noted that the recording data correcting section 158 corrects the recording data where the sheet-position judging section 153 has judged that the position recognized by the sheet-position recognizing section 148 is the position at which the image to be recorded becomes proper where the recording data is corrected by the recording data correcting section.

In view of the above, the recording data correcting section 159 is configured such that where the width of the recording sheet which has been derived by the sheet-position recognizing section 148 is smaller than the recording width of the image, the recording data correcting section 158 corrects the recording data so as to reduce the size of the image to be recorded such that the entirety of the image on the recording sheet is recorded, or so as to delete the portion of the image to be recorded, which portion is to be located off the recording medium.

Operations of Ink-jet Printer

Figure 11:
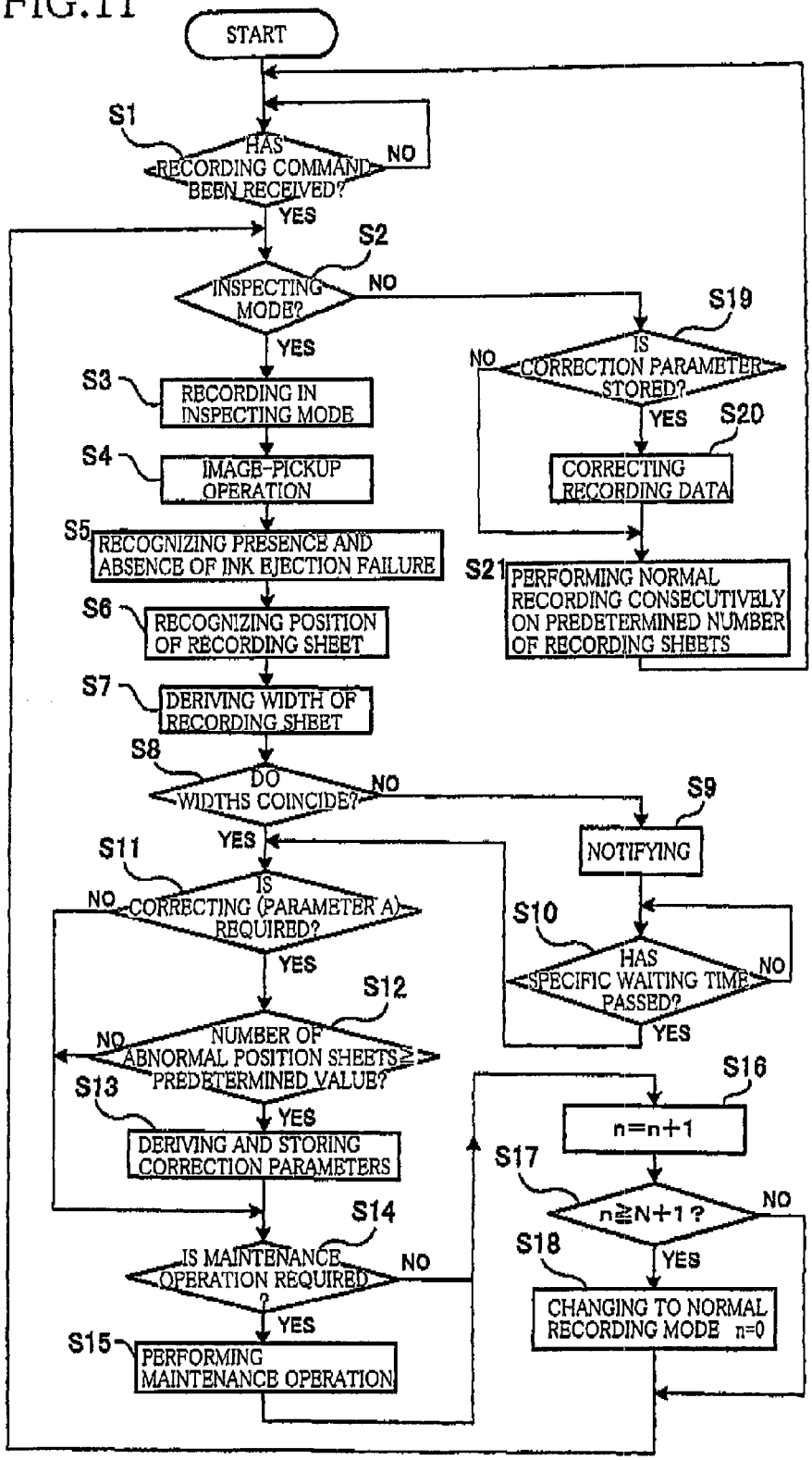
FIG. 11 is a flow-chart showing a processing of a controller of the ink-jet printer.

There will be next explained a processing of the controller 101 with reference to a flow-chart shown in FIG. 11. When the processing of the controller 101 is started, the controller 101 waits, in S1, for receiving, from the PC 100, a recording command including the recording data. This recording command is set to include the recording width of the image to be recorded on the basis of the recording data. When the recording command is received, the controller 101 judges, in S2, the mode stored in the mode storing section 141 is the normal recording mode or the inspecting mode. Where the mode is the inspecting mode (S2: YES), the processing goes to S3. In S3, the sheet-convey controlling section 143 controls the motor driver 122 such that the uppermost one of the recording sheets in the sheet tray 21 is conveyed onto the sheet-convey belt 8 by rotating of the pickup roller 22 which is caused by driving of the pickup motor 182, and controls the motor driver 123 such that the recording sheet is conveyed, while being held on the outer peripheral surface 8*a*, by the rotating of the belt roller 6 which is caused by driving of the sheet-convey motor 133. In addition, the head controlling section 142 controls the head driving circuit 121 such that the image based on the recording data transmitted from the PC 100 is to be recorded on the recording sheet (that is, an inspecting recording is performed).

In S4, the image-pickup controlling section 146 controls the image sensor 201 such that the image sensor 201 performs the image pickup operation of the image sensor 201 for the recording sheet on which the image based on the recording data transmitted from the PC 100 is recorded.

In S5, the ink-ejection-failure recognizing section 147 recognizes the presence and absence of the ink ejection failure of the ink-jet heads 2, for each of the ejection openings 3*b*, on the basis of the portion of the image data obtained in S4, which portion corresponds to the image. A result of this recognition is used for a judgment of whether the maintenance operation is performed or not in a later step described below.

In S6, the sheet-position recognizing section 148 recognizes the shift amount of the recording sheet in the main scanning direction and the inclination angle of the recording sheet with respect to the sheet-convey direction B on the basis of the portion of the image data obtained in S4, which portion includes the outline of the recording sheet.

In S7, where the image data obtained in S4 includes the opposite ends of the recording sheet along the sheet-convey direction B as shown in FIG. 7A, the sheet-position recognizing section 148 derives the width of the recording sheet on the basis of the image data.

In S8, the sheet-width judging section 152 judges whether the width of the recording sheet which has been derived by the sheet-position recognizing section 148 in S7 and the width of the recording sheet which is based on the data stored in the sheet-width storing section 150 coincide with each other. Where not coinciding (S8: NO), the processing goes to S9. In S9, the sheet-width judging section 152, as the nothing section, illuminates the notifying LED 128 to notify the operator about the fact that the widths do not coincide with each other. Then, in S10, the controller 101 waits for the operator to perform an operation for suspending the inspecting mode or for changing the data of the width of the recording sheet which is stored in the sheet-width storing section 150 until a specific waiting time has passed. In this way, in this ink-jet printer 1, where the width of the conveyed recording sheet and the width of the recording sheet which is based on the data stored in the sheet-width storing section 150 do not coincide with each other, the operator can be notified about the fact that the widths do not coincide with each other. Where the operator has not performed the operation during the specific waiting time, the processing goes to S11.

In S11, it is judged whether the correction for the recording data on the basis of the parameter A is required in the recording in the normal recording mode. Specifically, it is judged that the correction for the recording data is required, when the sheet-position judging section 153 has judged that the position of the recording sheet (at least one of the shift amount and the inclination angle) recognized in S6 by the sheet-position recognizing section 148 is not normal. Further, in this ink-jet printer 1, it is judged that the correction for the recording data is required, only when the sheet-position judging section 153 has judged that the position of the recording sheet (the shift amount and the inclination angle) recognized by the sheet-position recognizing section 148 is a position at which the image to be recorded on the recording sheet becomes proper where the recording data is corrected by the recording data correcting section 158. Thus, a needless correction can be canceled in advance. Where it is judged that the correction is required (S11: YES), the processing goes to S12. Where it is judged that the correction is not required (S11: NO), the processing goes to S14.

In S12, the abnormality-frequency judging section 155 initially judges whether the consecutive recording number in the inspecting mode has reached the predetermined number (in this ink-jet printer 1, the predetermined number is N). Then, where the consecutive recording number has reached the predetermined number, the abnormality-frequency judging section 155 judges whether the number of the abnormal position sheets among the recording sheets of the number N is equal to or greater than the predetermined value (which is extremely near the number N). Finally, the abnormality-frequency judging section 155 judges, where the number of the abnormal position sheets is equal to or greater than the predetermined value, whether the respective shift amounts and/or the respective inclination angles of all the abnormal position sheets are distributed over the specific fixed small range. Where these three conditions are all satisfied (S12: YES), the processing goes to S13. Where at least one of the three conditions is not satisfied (S12: NO), the processing goes to S14. It is noted that where the last condition of the three conditions is not satisfied, there is a possibility of a malfunction of the sheet-convey mechanism and the like, and thus the notifying LED 128 may be illuminated to notify the operator.

In S13, the correction parameter deriving section 156 derives the parameter A on the basis of the position of the recording sheet (the shift amount and the inclination angle) recognized in S6 by the sheet-position recognizing section 148. Further, it is judged whether the correction for the recording data on the basis of the parameter B is required in the recording in the normal recording mode. Specifically, it is judged that the correction for the recording data is required, where the sheet-width judging section 152 has judged that the width of the recording sheet which has been derived in S7 by the sheet-position recognizing section 148 is smaller than the recording width of the image to be recorded on the basis of the recording data which is transmitted from the PC 100. Accordingly, even where a recording sheet that does not meet standard is used, the image to be recorded on the recording sheet is allowed to become proper.

Where it is judged that the correction on the basis of the parameter B is required, the correction parameter deriving section 156 derives the parameter B. Specifically, on the basis of the set information stored in the correction setting storing section 159, the correction parameter deriving section 156 derives the correction parameter of the recording data for reducing the size of the image to be recorded such that the entirety of the image is recorded on the recording sheet, or derives the correction parameter for deleting the portion of the image to be recorded, which portion is to be located off the recording medium. The parameter A and the parameter B thus derived by the correction parameter deriving section 156 are stored in the correction parameter storing section 157. In this ink-jet printer 1, by providing the correction setting storing section 159, the recording is allowed in a manner desired by the operator where the width of the conveyed recording sheet is smaller than the recording width of the image to be recorded on the basis of the recording data.

Subsequently, in S14, the ink-ejection-failure recognizing section 147 judges, on the basis of the recognition thereof, whether the maintenance operation of the ink-jet heads 2 is required. Where the ink ejection failure does not occur, the ink-ejection-failure recognizing section 147 judges that the maintenance operation of the ink-jet heads 2 is not required (S14: NO), and the processing goes to S16. Where the ink ejection failure occurs, the ink-ejection-failure recognizing section 147 judges that the maintenance operation of the ink-jet heads 2 is required (S14: YES). In this case, where the ink ejection failure occurs only in one of the ink-jet heads 2, the ink-ejection-failure recognizing section 147 may judge that the maintenance operation is required only for the one ink-jet head 2. Then, the processing goes to S15 in which the maintenance unit 70 performs the maintenance operation for the ink-jet heads 2. After the maintenance operation is completed, the processing goes to S16.

Figure 12A:
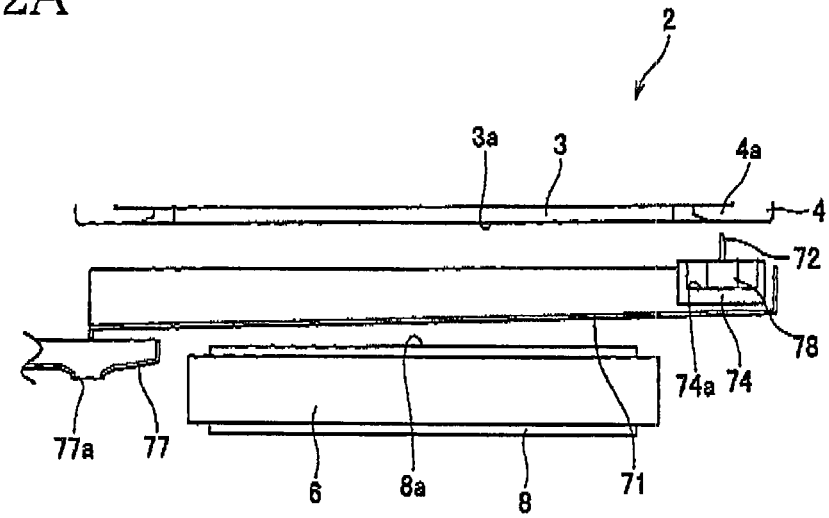
FIGS. 12A and 12B are side views each for explaining an maintenance operation of the ink-jet printer.
Figure 12B:
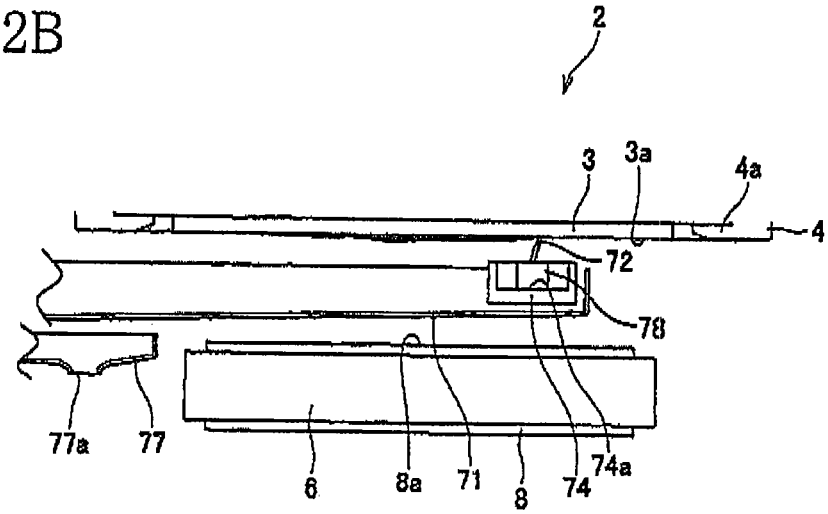

Here, there will be explained the maintenance operation of the ink-jet heads 2 performed in S15 with reference to FIGS. 12A and 12B. FIG. 12A is a side view showing that the frame 4 is moved from the recording position to the maintenance position, and the tray 71 of the maintenance unit 70 is moved to the maintenance position. FIG. 12B is a side view showing that the wiper 72 wipes the inks adhering to the ejection surfaces 3*a*.

When performing the purging operation which is for recovering the ink-jet heads 2 in which the ink ejection failure occurs, the frame 4 is moved to the maintenance position by the raising and lowering mechanisms 51. At this time, the two head motors 52 are driven so as to be synchronized with each other, thereby rotating the pinion gears 53 forwardly (in the clockwise direction in FIG. 3). As a result, the rack gears 54 are moved upward in accordance with the rotations of the pinion gears 53. The frame 4 fixed to the rack gears 54 is moved upward together with the four ink-jet heads 2. When the frame 4 has reached the maintenance position, the rotations of the head motors 52 are stopped.

As a result, between the ejection surfaces 3*a* and the sheet-convey belt 8, there is formed the space in which the maintenance unit 70 can be disposed. When the frame 4 is located at the maintenance position, the respective ejection surfaces 3*a* of the ink-jet heads 2 and the bottom surface of the frame 4 are located at a height position at which the distal ends of the wiper 72 and the circular projections 76*a* are not brought into contact with the respective ejection surfaces 3*a* of the ink-jet heads 2 and the bottom surface of the frame 4 when the maintenance unit 70 is moved to the maintenance position.

Then, the contacting members 84 are respectively brought into contact with the other end portions 83*b* of the respective hooking members 83, whereby the projecting portions 83*a* are respectively moved away from the recessed portions 74*b*. As a result, the recessed portions 74*b* and the respective projecting portions 83*a* are disengaged from each other. That is, the connection of the tray 71 and the tray 75 is released. Then, in this state, the timing belt 95 is moved by the driving of the tray motor 92 of the horizontally moving mechanism 91 such that the tray 71 is moved to the maintenance position. Then, when the tray 71 has reached the maintenance position as shown in FIG. 12A, the tray motor 92 is stopped to be driven.

Subsequently, the pumps (not shown) by which the inks in the respective ink cartridges (not shown) are forced to be introduced into the respective ink-jet heads 2 are driven, thereby performing the purging operation in which the inks are ejected from the ejection openings 3*b* of the ink-jet heads 2 into the tray 71. By performing the purging operation, clogging of the inks in the ejection openings 3*b* in which the ink ejection failure occurs and thickening of the inks in the ejection openings 3*b* are solved. The inks ejected into the tray 71 are moved toward the left side of FIG. 12A on and along a bottom surface of the tray 71, and then flow into the waste-ink receiving tray 77. Then, the inks used in the purging operation are discharged from the ink-discharge opening 77*a* of the waste-ink receiving tray 77. A part of the inks, however, remains on the ejection surfaces 3*a* as ink droplets.

Thereafter, the ink-jet heads 2 are moved downward by the raising and lowering mechanisms 51. At this time, the ink-jet heads 2 are located at a height position at which the distal end of the wiper 72 can be brought into contact with the ejection surfaces 3*a* and the bottom surface of the frame 4 when the tray 71 is moved toward the left side (that is, to the retracted position). Then, as shown in FIG. 12B, the tray 71 is moved toward the left side by the horizontally moving mechanism 91 (that is, the tray 71 is moved from the maintenance position to the retracted position).

By this operation, the wiper 72 is moved in a wiping direction (a first direction) that is directed from the right side toward the left side in FIG. 12A, whereby the wiping operation of the wiper 72 for the ejection surfaces 3*a* is performed. At this time, since the distal end (an upper end) of the wiper 72 is located above a height level of the bottom surface of the frame 4, the wiper 72 contacts with the bottom surface of the frame 4 and the ejection surfaces 3*a* while being deformed or warped, thereby wiping the inks adhering to the ejection surfaces 3*a* by the purging operation. By performing the maintenance operation, the ink-jet heads 2 can be recovered from the ink ejection failure to a normal condition.

In S16, the controller 101 increments, by one, a consecutive recording number parameter n in the inspecting mode, which parameter is counted by a counter (not shown). Then, in S17, the controller 101 judges whether the consecutive recording number parameter n reaches N+1. Where the consecutive recording number parameter n has reached N+1 (S17: YES), the processing goes to S18. Where the consecutive recording number parameter n has not reached N+1 (S17: NO), the processing returns to S3 via S2. Then, the above-described transactions in the inspecting mode are executed again.

In S18, the information indicating the mode stored in the mode storing section 141 is changed to the information indicating the normal recording mode. Further, the consecutive recording number parameter n is initialized to zero. Thereafter, the processing returns to s2. Accordingly, the mode is judged to the normal recording mode in the judgment in S2 (S2: NO), and the processing goes to S19.

In S19, it is judged whether at least the parameter A is stored in the correction parameter storing section 157. Where the parameter A and the parameter B are stored, for example (S19: YES), the recording data received in S1 from the PC 100 is corrected, in S20, on the basis of the parameter A and the parameter B. That is, the recording data correcting section 158 corrects the recording data transmitted to the recording head when the abnormality-frequency judging section 155 has judged that the ratio of the number of the abnormal position sheets becomes equal to or greater than the threshold. Accordingly, even where the recording sheet conveyed by the sheet-convey mechanism is shifted in the widthwise direction thereof and/or inclined from the nominal position of the recording sheet and even where the width of the conveyed recording sheet does not coincide with the recording width of the image to be recorded on the basis of the recording data, the image to be recorded on the recording sheet is allowed to become proper. It is noted that, in this ink-jet printer 1, conveying of the recording sheet by the sheet-convey mechanism is decelerated or stopped until the correction of the recording data by the recording data correcting section 158 is completed. This allows an adequate time for the correcting to be assured. Where either of the correction parameters is not stored (S19: NO), the processing goes to S21. In S21, on the basis of the corrected recording data, normal recording is performed consecutively on the predetermined number of the recording sheets, which number is commanded by the recording command received in S1. Then, the processing returns to S1.

In this printer, the image to be recorded on the recording sheet can become proper (that is, the proper image can be recorded on the recording sheet), even though the printer has a relatively simple structure, by using the image sensor 201 both for detecting the presence and absence of the ink ejection failure and for detecting the sheet conveying failure caused by the sheet-convey mechanism. Thus, the ink-jet printer 1 with high quality recording and a relatively low cost can be made available. Further, since both of the detection of the ink ejection failure and the detection of the sheet conveying failure caused by the sheet-convey mechanism can be performed for single sheet conveying, a period until satisfactory recording on the recording sheet becomes possible can be reduced. Furthermore, since the correction by which the detected sheet conveying failure is compensated is performed, the image to be recorded on the recording sheet can become proper. This eliminates a risk in which a back surface of the recording sheet is soiled with the inks having attached onto the outer peripheral surface 8*a* of the sheet-convey belt 8, and a risk of a malfunction of the apparatus owing to the soil.

Where performing a center alignment in which a center of the recording sheet in the widthwise direction thereof is aligned with a specific position of the apparatus, a position of the recording sheet tends to be deviated. However, even where the recording sheet is conveyed while being shifted in the widthwise direction thereof owing to the deviation of the position of the recording sheet, the correction is possible by adjusting the recording data with the shift amount.

In this ink-jet printer 1, the maintenance operation is performed where the ink ejection failure is detected in the inspecting mode. Thus, there is no risk in which is formed a white patch or line, or unevenness of the image recorded on the recording sheet having subjected to the recording in the normal recording mode.

In this ink-jet printer 1, only where a frequency of occurrence of the sheet conveying failure exceeds a predetermined number of times (ratio), the recording data is corrected on the basis of the parameter A. Thus, where the sheet conveying failure accidentally occurs in only one of the plurality of the recording sheets in the inspecting mode, for example, the needless correction of the recording data can be prevented.

In this ink-jet printer 1, the image sensor 201 is disposed downstream of the ink-jet heads 2 in the sheet-convey direction B. Thus, the image-pickup operation of the image sensor 201 can be performed by performing the normal recording, that is, by conveying the recording sheet downstream on which the image has been recorded by the ink-jet heads 2.

It is noted that the ink-jet printer 1 does not always need to operate in the inspecting mode before in the normal recording mode. For example, the parameter A obtained by operating of the ink-jet printer 1 in the inspecting mode once may also be used in repeating the recording operation on the plurality of the recording sheets in the normal recording mode.

It is to be understood that the present invention is not limited to the details of the illustrated embodiment, but may be embodied with various changes and modifications, which may occur to those skilled in the art, without departing from the spirit and scope of the present invention. For example, in the illustrated embodiment, the abnormality-frequency judging section 155 judges, in S12, the three conditions, one of which is whether the consecutive recording number in the inspecting mode has reached the predetermined number N. However, the three conditions may not be judged by setting the consecutive recording number in the inspecting mode to only one. Further, the sheet-position recognizing section 148 may not have the width deriving function. In this case, the recording data correcting section 158 only makes a correction using the parameter A.

In the illustrated embodiment, the recording and the image-pickup operation are performed in the inspecting mode, but the present invention may also be applied to an image recording apparatus not having the inspecting mode. In this case, the ink ejection failure and the sheet conveying failure may be detected by performing the recording of the image and the image-pickup operation for the recording sheets of the predetermined number in the normal recording mode. In this operation, there is a risk that the image to be recorded on the recording sheet does not become proper until the correction parameter is derived, but, in this case, the recording may be performed again for the recording sheet(s) of a required number after the recording is completed.

Further, the image sensor 201 may be disposed on an upstream side of the ink-jet heads 2 in the sheet-convey direction B. Where the image sensor 201 is thus disposed, the image sensor 201 performs the image-pickup operation, for example, with the sheet-convey belt circulated once in a state that the recording sheet on which the image has been recorded is placed on or affixed to the sheet-convey belt, or with the sheet-convey belt reversely rotated. A position at which the image sensor 201 is attached is not limited to the side faces of the respective ink-jet heads 2. That is, the image sensor 201 may be attached to a side face of the frame 4. Further, in the illustrated embodiment, the one image sensor is used, but a plurality of the image sensors may be used.

What is claimed is:

1. An image recording apparatus comprising:

a medium-convey mechanism which conveys a recording medium;

a recording head having an ejection surface from which liquid is ejected toward a surface of the recording medium being conveyed by the medium-convey mechanism and on which is provided a liquid ejection area extending in an ejection-area extending direction perpendicular to a medium-convey direction in which the recording medium is conveyed by the medium-convey mechanism;

an image sensor having a pickup range extending in the ejection-area extending direction, and configured to perform an image-pickup operation for the surface of the recording medium being conveyed by the medium-convey mechanism; and a controller configured to execute controls for operations of the image recording apparatus, wherein the controller includes:

a normal recording section configured to record an image corresponding to image recording data of a recording command received by the image recording apparatus on a plurality of recording media indicated by the recording command in a normal recording mode, wherein the image sensor is configured not to perform the image-pickup operation for the plurality of recording media on which the image corresponding to the recording command has been recorded by the normal recording section in the normal recording mode;

an inspecting recording section configured to record an image, which corresponds to the image recording data of the received recording command, on at least one recording medium in an inspecting mode;

an image-pickup controlling section configured to control the image sensor in the inspecting mode, such that the image sensor performs the image-pickup operation for the at least one recording medium on which the image corresponding to image recording data of the received recording command has been recorded by the inspecting recording section;

a liquid-ejection-failure recognizing section configured to recognize presence and absence of a liquid ejection failure of the recording head on the basis of a portion of image data obtained by the image-pickup operation of the image sensor controlled by the image-pickup controlling section, which portion corresponds to the image corresponding to the image recording data of the received recording command;

a maintenance section configured to perform a maintenance process on the recording head to restore the recording head after the liquid-ejection failure recognized by the liquid-ejection-failure recognizing section, wherein the maintenance section performs the maintenance process on a portion of the recording head where the liquid-ejection-failure recognizing section recognizes the presence of the liquid ejection failure;

a medium-position recognizing section configured to recognize a position of the at least one recording medium on which the image corresponding to the image recording data of the received recording command has been recorded by the inspecting recording section in the inspecting mode, wherein the position is relative to the recording head, and the medium-position recognizing section is configured to recognize the position on the basis of the portion of the image data obtained by the image-pickup operation of the image sensor in the inspecting mode, which portion includes data corresponding to an outline of the at least one recording medium;

a medium-position judging section configured to judge whether the position of the at least one recording medium which has been recognized by the medium-position recognizing section is normal; and a recording data correcting section configured to correct, where the medium-position judging section has judged that the position of the at least one recording medium is not normal, recording data transmitted to the recording head such that an image to be recorded on the recording medium on the basis of the recording data becomes proper, wherein the inspecting mode is set to be established in advance of the normal recording mode, and wherein the normal recording section is configure to record the image corresponding to the image recording data of the received recording command on the plurality of recording media based on the recording data corrected by the recording data correcting section in the normal recording mode.

2. The image recording apparatus according to claim 1, wherein the medium-position recognizing section is configured to recognize the position of the recording medium in the ejection-area extending direction, and wherein the recording data correcting section is configured to correct, on the basis of the position of the recording medium which has been recognized by the medium-position recognizing section, the recording data such that the image to be recorded on the recording medium is shifted in the ejection-area extending direction.

3. The image recording apparatus according to claim 2, wherein the controller further includes a medium-width storing section configured to store data of a width of the recording medium to be conveyed by the medium-convey mechanism, and wherein where the image data obtained by the image-pickup operation of the image sensor does not include data corresponding to one of opposite end portions of the recording medium, which end portions extend in the medium-convey direction, the medium-position recognizing section recognizes the position of the recording medium in the ejection-area extending direction on the basis of: data corresponding to the other of the opposite end portions in the image data obtained by the image-pickup operation of the image sensor; and the data of the width of the recording medium which is stored in the medium-width storing section.

4. The image recording apparatus according to claim 1, wherein the medium-position recognizing section is configured to recognize an inclination angle of the recording medium relative to the medium-convey direction, and wherein the recording data correcting section is configured to correct the recording data such that the image to be recorded on the recording medium is not inclined, on the basis of the inclination angle of the recording medium which is recognized by the medium-position recognizing section.

5. The image recording apparatus according to claim 1, wherein when the plurality of recording media are conveyed by the medium-convey mechanism, and at least a part of the recording media whose positions are not normal are defined as abnormal position media, wherein the controller further includes an abnormality-frequency judging section configured to judge whether a ratio of the number of the abnormal position media to the plurality of recording media is equal to or greater than a threshold, and wherein the recording data correcting section is configured to correct the recording data transmitted to the recording head when the abnormality-frequency judging section judges that the ratio of the number of the abnormal position media becomes equal to or greater than the threshold.

6. The image recording apparatus according to claim 1, wherein the image sensor is disposed on a downstream side of the recording head in the medium-convey direction.

7. The image recording apparatus according to claim 1, wherein the controller further includes:

a medium-width storing section configured to store data of a width of the recording medium to be conveyed by the medium-convey mechanism;

a width deriving section configured to derive, where the image data obtained by the image-pickup operation of the image sensor includes data corresponding to both of opposite end portions of the recording medium, which end portions extend in the medium-convey direction, a width of the recording medium conveyed by the medium-convey mechanism on the basis of the image data;

a medium-width judging section configured to judge whether (a) the width of the recording medium which has been derived by the width deriving section and (b) the width of the recording medium which is based on the data stored in the medium-width storing section coincide with each other; and a notifying section configured to notify that the widths do not coincide with each other when the medium-width judging section judges that the widths do not coincide with each other.

8. The image recording apparatus according to claim 1, wherein the controller further includes:

a width deriving section configured to derive, when the image data obtained by the image-pickup operation of the image sensor includes data corresponding to both of opposite end portions of the recording medium, which end portions extend in the medium-convey direction, a width of the recording medium conveyed by the medium-convey mechanism on the basis of the image data; and a size-relationship detecting section configured to detect a size relationship between the width of the recording medium which has been derived by the width deriving section and a recording width of the image to be recorded, and wherein the recording data correcting section is configured such that where the width of the recording medium which has been derived by the width deriving section is less than the recording width of the image to be recorded, the recording data correcting section corrects the recording data so as to reduce a size of the image to be recorded such that an entirety of the image to be recorded on the recording medium is recorded, or so as to delete a portion of the image to be recorded, which portion is to be located off the recording medium.

9. The image recording apparatus according to claim 8, wherein the recording data correcting section is configured such that when the width of the recording medium which has been derived by the width deriving section is equal to or greater than the recording width of the image to be recorded, the recording data correcting section does not correct the recording data as to the size of the image to be recorded.

10. The image recording apparatus according to claim 8, wherein the controller further includes a correction setting storing section configured to store information about whether the recording data correcting section corrects the recording data so as to reduce the size of the image to be recorded, or so as to delete the portion of the image to be recorded where the width of the recording medium which has been derived by the width deriving section is less than the recording width of the image to be recorded.

11. The image recording apparatus according to claim 1, wherein the medium-position judging section is configured to judge whether the position recognized by the medium-position recognizing section is a position at which the image to be recorded becomes proper where the recording data is corrected by the recording data correcting section, and wherein the recording data correcting section is configured to correct the recording data where the medium-position judging section has judged that the position recognized by the medium-position recognizing section is the position at which the image to be recorded becomes proper.

12. The image recording apparatus according to claim 1, wherein the conveying of the recording medium by the medium-convey mechanism is decelerated or stopped until the correction of the recording data by the recording data correcting section is completed.

13. The image recording apparatus according to claim 1, wherein the medium-position recognizing section is configured to recognize the position of the recording medium, for which the image-pickup operation has been performed by the image sensor.

14. The image recording apparatus according to claim 1, wherein the controller further comprises a mode storing section configured to store information indicating whether the image recording is in the normal recording mode or the inspecting mode, wherein, when the image recording apparatus is in the inspecting mode, the recording head records the predetermined image on a plurality of recording media in the inspecting mode, and wherein, when the recording head has recorded the predetermined image on a predetermined number of the recording media in the inspecting mode, the controller changes the mode of the image recording apparatus from the inspecting mode to the normal recording mode.

15. The image recording apparatus according to claim 1, wherein the recording data correcting section is configured to correct the recording data before the recording head begins to record the predetermined image on the recording medium in the normal recording mode.

16. An image recording apparatus comprising:

a medium-convey mechanism which conveys a recording medium;

a recording head having an ejection surface from which liquid is ejected toward a surface of the recording medium being conveyed by the medium-convey mechanism and on which is provided a liquid ejection area extending in an ejection-area extending direction perpendicular to a medium-convey direction in which the recording medium is conveyed by the medium-convey mechanism;

at least one image sensor each having a pickup range extending in a direction that is the same as the ejection-area extending direction, and each configured to perform an image-pickup operation for the surface of the recording medium being conveyed by the medium-convey mechanism; and a controller configured to execute controls for operations of the image recording apparatus, wherein the controller includes:

a normal recording section configured to record an image corresponding to image recording data of a recording command received by the image recording apparatus on a plurality of recording media indicated by the recording command in a normal recording mode, wherein the image sensor is configured not to perform the image-pickup operation for the plurality of recording media on which the image corresponding to the recording command has been recorded by the normal recording section in the normal recording mode;

an inspecting recording section configured to record an image, which corresponds to the image recording data of the received recording command, on at least one recording medium in an inspecting mode;

an image-pickup controlling section configured to control the image sensor in the inspecting mode, such that the image sensor performs the image-pickup operation for the at least one recording medium on which the image corresponding to image recording data of the received recording command has been recorded by the inspecting recording section;

a liquid-ejection-failure recognizing section configured to recognize presence and absence of a liquid ejection failure of the recording head on the basis of a portion of image data obtained by the image-pickup operation of the image sensor controlled by the image-pickup controlling section, which portion corresponds to the image corresponding to the image recording data of the received recording command;

a maintenance section configured to perform a maintenance process on the recording head to restore the recording head after the liquid-ejection failure recognized by the liquid-ejection-failure recognizing section, wherein the maintenance section performs the maintenance process on a portion of the recording head where the liquid-ejection-failure recognizing section recognizes the presence of the liquid ejection failure;

a medium-position recognizing section configured to recognize a position of the at least one recording medium on which the image corresponding to the image recording data of the received recording command has been recorded by the inspecting recording section in the inspecting mode, wherein the position is relative to the recording head, and the medium-position recognizing section is configured to recognize the position on the basis of the portion of the image data obtained by the image-pickup operation of the image sensor in the inspecting mode, which portion includes data corresponding to an outline of the at least one recording medium;

a medium-position judging section configured to judge whether the position of the at least one recording medium which has been recognized by the medium-position recognizing section is normal; and a recording data correcting section configured to correct, where the medium-position judging section has judged that the position of the at least one recording medium is not normal, recording data transmitted to the recording head such that an image to be recorded on the recording medium on the basis of the recording data becomes proper, wherein the inspecting mode is set to be established in advance of the normal recording mode, and wherein the normal recording section is configure to record the image corresponding to the image recording data of the received recording command on the plurality of recording media based on the recording data corrected by the recording data correcting section in the normal recording mode.

* * * * *